US012312954B2

(12) United States Patent
Jamieson et al.

(10) Patent No.: US 12,312,954 B2
(45) Date of Patent: May 27, 2025

(54) METHODS AND APPARATUS FOR BITLESS DRILLING

(71) Applicant: Helmerich & Payne Technologies, LLC, Tulsa, OK (US)

(72) Inventors: Angus Lamberton Jamieson, Inverness (GB); Todd W. Benson, Dallas, TX (US)

(73) Assignee: Helmerich & Payne Technologies, LLC, Tulsa, OK (US)

( * ) Notice: Subject to any disclaimer, the term of this patent is extended or adjusted under 35 U.S.C. 154(b) by 0 days.

(21) Appl. No.: 18/189,918

(22) Filed: Mar. 24, 2023

(65) Prior Publication Data

US 2023/0304359 A1 Sep. 28, 2023

Related U.S. Application Data

(60) Provisional application No. 63/387,910, filed on Dec. 16, 2022, provisional application No. 63/269,846, filed on Mar. 24, 2022.

(51) Int. Cl.
*E21B 7/14* (2006.01)

(52) U.S. Cl.
CPC ..... *E21B 7/14* (2013.01)

(58) Field of Classification Search
CPC ... E21B 7/14; E21B 7/18; E21B 7/143; E21B 7/146
See application file for complete search history.

(56) References Cited

U.S. PATENT DOCUMENTS 3,195,637 A * 7/1965 Wayte ..... E21B 36/008 166/58
3,620,313 A 11/1971 Elmore et al.
4,073,351 A 2/1978 Baum
(Continued)

FOREIGN PATENT DOCUMENTS

WO 9603566 A2 2/1996

OTHER PUBLICATIONS

PCT/US2023/016298, "International Search Report and Written Opinion", Jun. 2, 2023, 12 pages.
(Continued)

*Primary Examiner* — David Carroll
(74) *Attorney, Agent, or Firm* — Kilpatrick Townsend & Stockton LLP

(57) ABSTRACT

Apparatus and methods of drilling using a bitless drilling assembly can include a propellant chamber configured to store a liquid propellant for drilling. The bitless drilling assembly can include a burner nozzle connected to the propellant chamber via one or more passages to route the liquid propellant from the propellant chamber to the burner nozzle. The bitless drilling assembly can include an ignitor configured to ignite the liquid propellant as the liquid propellant escapes the burner nozzle. The bitless drilling assembly can include a diverter cage placed in a path of the inside passage to divert one or more propellant capsules from the inside passage to a capsule blade. The capsule blade can be configured to puncture the one or more propellant capsules to allow the propellant to flow into a reservoir and route the propellant to the propellant chamber. The bitless drilling assembly can be controlled automatically during drilling.

19 Claims, 23 Drawing Sheets

(56) References Cited

U.S. PATENT DOCUMENTS

| | | | | |
|---|---|---|---|---|
| 8,210,283 | B1 * | 7/2012 | Benson | E21B 47/10 175/45 |
| 2010/0032206 | A1 * | 2/2010 | Becker | E21B 7/007 175/4.5 |
| 2010/0089577 | A1 * | 4/2010 | Wideman | E21B 7/14 166/272.6 |
| 2011/0303460 | A1 * | 12/2011 | Rudolf Von Rohr | E21B 7/14 175/14 |
| 2013/0264118 | A1 * | 10/2013 | Wideman | E21B 41/0078 175/17 |
| 2014/0096970 | A1 * | 4/2014 | Andrew | E21B 43/14 166/308.1 |
| 2014/0151045 | A1 * | 6/2014 | Galey | E21B 33/13 166/288 |
| 2017/0138128 | A1 * | 5/2017 | Russell | E21B 7/007 |
| 2019/0186248 | A1 * | 6/2019 | Sherman | C09K 8/665 |
| 2019/0226336 | A1 * | 7/2019 | Benson | E21B 44/00 |
| 2020/0080409 | A1 * | 3/2020 | Haggerty | E21B 7/04 |
| 2020/0126386 | A1 * | 4/2020 | Michalopulos | G08B 21/02 |
| 2020/0248547 | A1 * | 8/2020 | Fitzgerald | E21B 41/00 |
| 2020/0256181 | A1 * | 8/2020 | Jamieson | E21B 7/00 |
| 2020/0300064 | A1 * | 9/2020 | Gee | E21B 44/00 |
| 2020/0355066 | A1 * | 11/2020 | Maus | E21B 47/02 |
| 2020/0362687 | A1 * | 11/2020 | Hopwood | E21B 44/00 |
| 2020/0378248 | A1 * | 12/2020 | Maus | E21B 47/06 |
| 2021/0115742 | A1 * | 4/2021 | Agarwal | G01D 5/14 |
| 2021/0366256 | A1 * | 11/2021 | Michalopulos | E21B 44/00 |
| 2021/0381361 | A1 * | 12/2021 | Maus | E21B 47/09 |
| 2022/0056796 | A1 * | 2/2022 | Jamieson | E21B 44/02 |
| 2023/0069702 | A1 * | 3/2023 | Benson | F03G 4/00 |

OTHER PUBLICATIONS

PCT/US2023/016298, International Preliminary Report on Patentability, Oct. 3, 2024, 8 pages.

* cited by examiner

PRIOR ART

Hose Protector Sub

Central Hose Holder

METHODS AND APPARATUS FOR BITLESS DRILLING

CROSS-REFERENCES TO RELATED APPLICATIONS

This application claims the benefit of priority of U.S. Provisional Patent Application No. 63/269,846, entitled "METHODS AND APPARATUS FOR BITLESS DRILLING." filed Mar. 24, 2022, and claims the benefit of priority of U.S. Provisional Patent Application No. 63/387,910, entitled "METHODS AND APPARATUS FOR BITLESS DRILLING," filed Dec. 16, 2022, both of which are hereby incorporated by reference in their entirety and for all purposes.

This application is related to U.S. Provisional Patent Application Ser. No. 63/260,797, entitled "Systems and Method for Drilling Geothermal Wells" filed on Aug. 31, 2021, to U.S. Provisional Patent Application Ser. No. 63/269,846, entitled "Methods and Apparatus for Bitless Drilling" filed on Mar. 24, 2022, to U.S. Non-provisional patent application Ser. No. 17/823,485 filed on Aug. 30, 2022, entitled "Systems and Methods for Drilling Geothermal Wells" filed on Aug. 30, 2022, and to U.S. Provisional Patent Application Ser. No. 63/380,448, entitled "Systems and Methods for Generating and Storing Energy" filed on Oct. 21, 2022, each of which is incorporated herein by reference in their entirety and for all purposes.

FIELD OF THE DISCLOSURE

The present disclosure provides systems and methods useful for drilling a well, such as an oil and gas well. The systems and methods can be computer-implemented using processor executable instructions for execution on a processor and can accordingly be executed with a programmed computer system.

DESCRIPTION OF THE RELATED ART

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling and may not be capable of gathering and processing various information from downhole sensors and surface control systems in a timely manner, in order to improve drilling operations and minimize drilling errors.

In the oil and gas industry, extraction of hydrocarbon natural resources is done by physically drilling a hole to a reservoir where the hydrocarbon natural resources are trapped. The hydrocarbon natural resources can be up to 10,000 feet or more below the ground surface and be buried under various layers of geological formations. Drilling operations can be conducted by having a rotating drill bit mounted on a bottom hole assembly (BHA) that gives direction to the drill bit for cutting through geological formations and enabled steerable drilling.

SUMMARY

In an aspect, an apparatus for drilling, can include a propellant chamber configured to store a liquid propellant for drilling; a burner nozzle connected to the propellant chamber via one or more passages to route the liquid propellant from the propellant chamber to the burner nozzle, and an ignitor configured to ignite the liquid propellant as the liquid propellant escapes the burner nozzle.

In various embodiments, the apparatus can include a connector for coupling a propellant feed hose.

In various embodiments, the burner nozzle is encased in a drill pipe to create a path for a drilling fluid that bypasses the burner nozzle and feeds fluid down an inside passage and up an outside passage of the drill pipe.

In various embodiments, the apparatus can include a diverter cage placed in a path of the inside passage to divert one or more propellant capsules from the inside passage to a capsule blade; the capsule blade configured to puncture the one or more propellant capsules; and a reservoir configured to capture the propellant from the one or more propellant capsules and route the fuel to the propellant chamber.

In various embodiments, the apparatus can include a diverter configured to route one or more pierced capsules to the outside passage of the large internal diameter drill pipe.

In various embodiments, the apparatus can include a burner nozzle monitor configured to detect a condition of the burner nozzle; and a compressed gas cylinder coupled to the drill pipe, the compressed gas cylinder configured to release the compressed gas into a chamber to cause the apparatus to float to a surface of a borehole.

In various embodiments, the diverter cage comprises a mesh size smaller than a diameter of the one or more propellant capsules.

In various embodiments, wherein the burner nozzle comprises a high temperature, high abrasion ceramic.

In an aspect of the disclosure a bottom hole assembly for drilling a borehole can include a propellant chamber configured to store a liquid propellant for drilling, a burner nozzle connected to the propellant chamber via one or more passages to route the liquid fuel from the propellant chamber to the burner nozzle, and an ignitor configured to ignite the liquid fuel as the propellant escapes the burner nozzle.

In various embodiments, the bottom hole assembly can include a connector for coupling a propellant feed house. In various embodiments, the burner nozzle is encased in a large internal diameter drill pipe to create a path for a drilling fluid that bypasses the burner nozzle and feeds fluid down an inside passage and up an outside passage of the large internal diameter drill pipe.

In various embodiments, the bottom hole assembly or other components of the drill string can include a diverter cage placed in a path of the inside passage to divert one or more propellant capsules from the inside passage to a capsule blade; the capsule blade configured to puncture the one or more propellant capsules; and a reservoir configured to capture the propellant from the one or more propellant capsules and route the fuel to the propellant chamber. In other embodiments, a diverter system may be used which directs the fuel capsules to a centrally located blade or blades which pierce or cut an outer layer of the capsule and release the fuel into the fuel feed house.

In various embodiments, the bottom hole assembly can include a diverter configured to route one or more pierced capsules to the outside passage of the large internal diameter drill pipe.

In various embodiments, the bottom hole assembly can include a burner nozzle monitor configured to detect a condition of the burner nozzle, and a compressed gas cylinder coupled to the large internal diameter pipe, the compressed gas cylinder configured to release the compressed gas into a chamber to cause the apparatus to float to a surface of a borehole.

In various embodiments, the diverter cage comprises a mesh size smaller than a diameter of the one or more propellant capsules.

In various embodiments, the burner nozzle comprises a high temperature, high abrasion ceramic.

In various aspects, a method for drilling a borehole using a bitless drill assembly can include storing a liquid propellant in a propellant chamber; routing the liquid propellant from the propellant chamber to a burner nozzle via one or more passages; igniting the liquid propellant at the burner nozzle; and drilling a formation using the liquid propellant.

In various embodiments, the method can include receiving additional liquid propellant to the propellant chamber visa a coupling for a fuel hose, which can be located within the drill string and coupled to a tool for combustion and bitless drilling that is located at least partially if not wholly within the bottom hole assembly. In some embodiments, a fuel hose can be disposed within a drill string and connected to a tool located within a bottom hole assembly.

In various embodiments, the method can include diverting one or more fuel capsules from an inside passage of a pipe encasing the bitless drill assembly; piercing the one or more fuel capsules using a capsule blade; and capturing the propellant from the one or more fuel capsules. In some embodiments, the fuel capsules may comprise an outer layer which has a first density that is lower than the density of the fuel, so that the outer layer can be carried back to or rise to the surface through the drilling fluid, while the fuel within the capsule sinks within the drilling mud and is collected for use.

In various embodiments, the method can include routing the one or more fuel capsule outer layers from the capsule blade to a surface via an outside passage of the pipe encasing the bitless drill assembly.

In still other embodiments, the systems may include the use of a sub coupled to the respective ends of pipe that are joined together with the sub, wherein each piece of the drill pipe comprises a thin tube which extends longitudinally through the pipe and into the sub, wherein the tube opens into an interior chamber of the sub which is isolated from the drilling mud by two seals, wherein the sub allows the flow of drilling mud from one drill pipe through a portion of the sub to the next drill pipe connected that are connected together by the sub.

BRIEF DESCRIPTION OF THE DRAWINGS

For a more complete understanding of the present invention and its features and advantages, reference is now made to the following description, taken in conjunction with the accompanying drawings, in which.

Like reference symbols in the various drawings indicate like elements, in accordance with certain example implementations. In addition, multiple instances of an element may be indicated by following a first number for the element with a letter or a hyphen and a second number.

BACKGROUND

Figure 1:
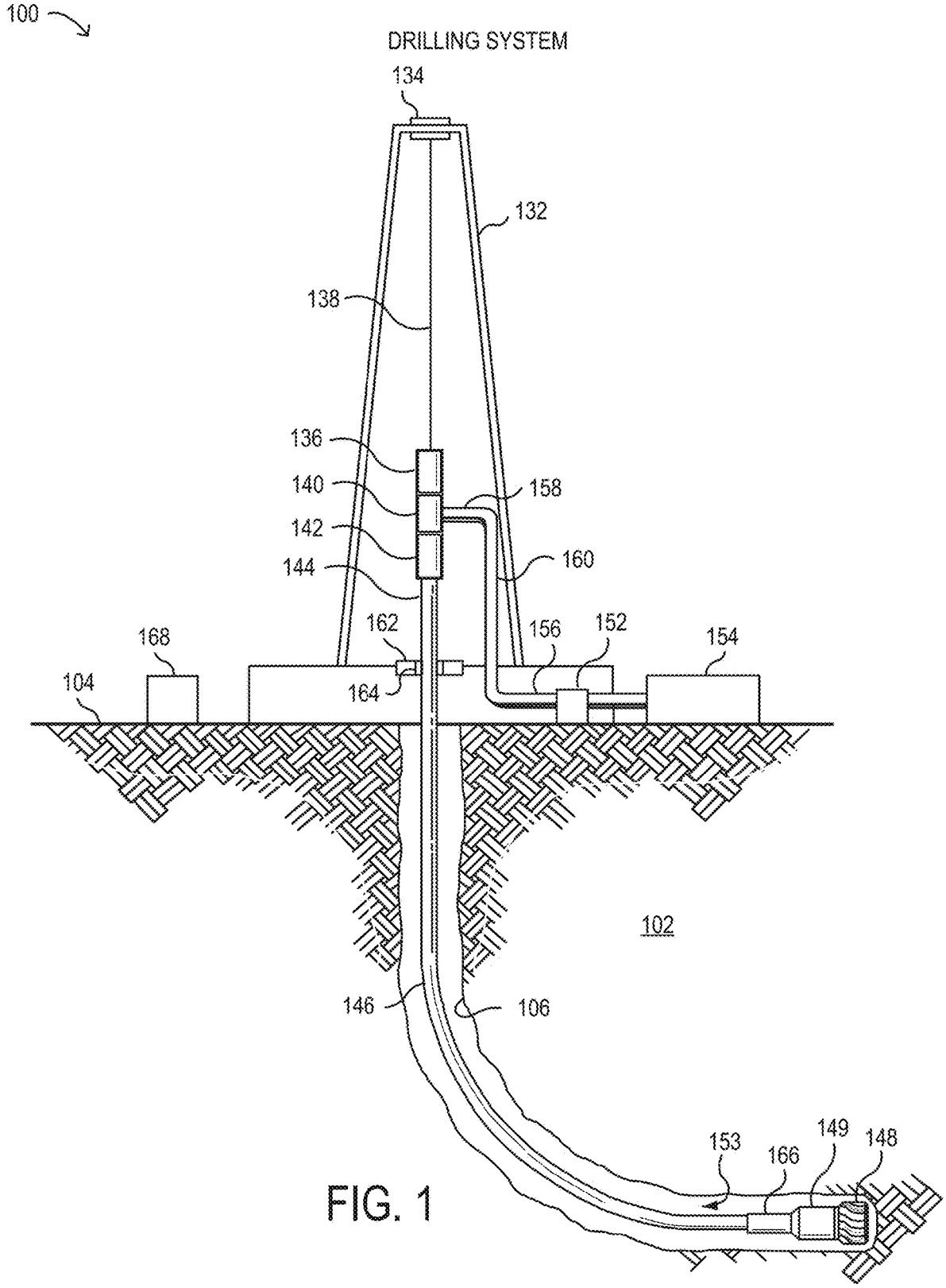
FIG. 1 is a depiction of a drilling system for drilling a borehole.

In the following description, details are set forth by way of example to facilitate discussion of the disclosed subject matter. It is noted, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve desirable drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

Therefore, the well plan may be updated based on new stratigraphic information from the wellbore, as it is being drilled. This stratigraphic information can be gained on one hand from measurement while drilling (MWD) and logging while drilling (LWD) sensor data, but could also include other reference well data, such as drilling dynamics data or sensor data giving information, for example, on the hardness of the rock in individual strata layers being drilled through.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a travelling block 136 is coupled via a drilling line 138. In drilling system 100, a top drive 140 is coupled to travelling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture 153 (e.g. a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149 that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to drilling rig 210, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
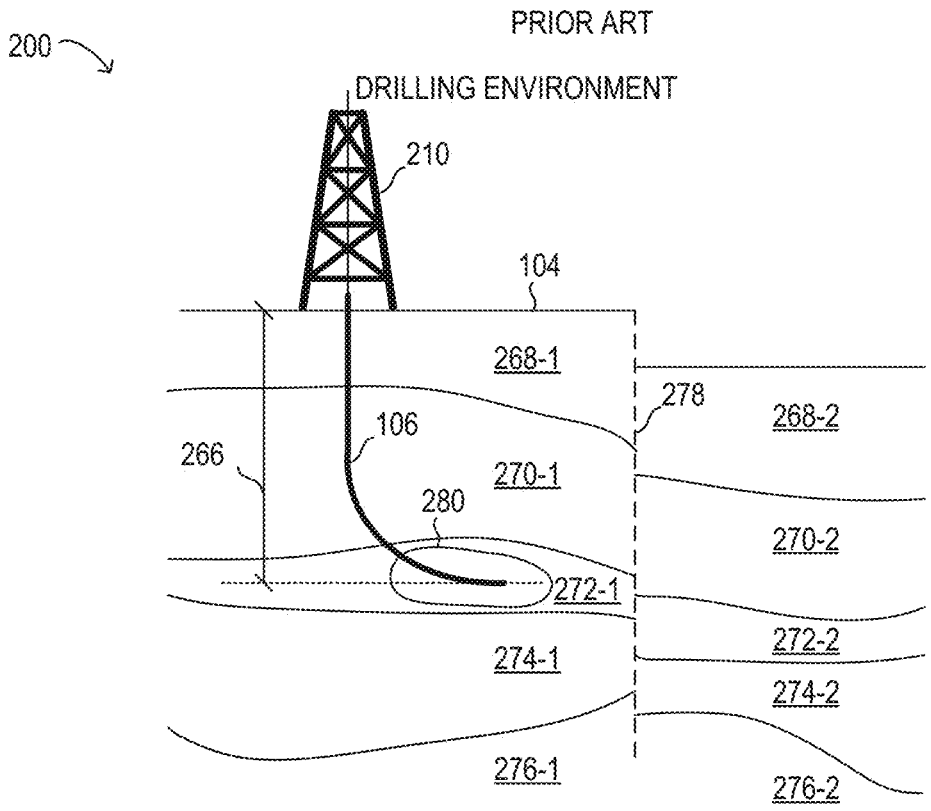
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan)has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drilling plan using subsurface coordinates, or references to certain markers, that indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of drill string 146.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-2, 272-2, 274-2, and 276-2 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used to alter an angle of borehole 106 to accommodate subterranean faults, such as indicated by fault line 278 in FIG. 1. Other benefits that may be achieved using directional drilling include sidetracking off of an existing well to reach a different target area or a missed target area, drilling around abandoned drilling equipment, drilling into otherwise inaccessible or difficult to reach locations (e.g., underpopulated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staving within a strata layer that varies in depth and thickness as illustrated by strata layer 272. As such, directional drilling may involve multiple vertical adjustments that complicate the trajectory of borehole 106.

Figure 3:
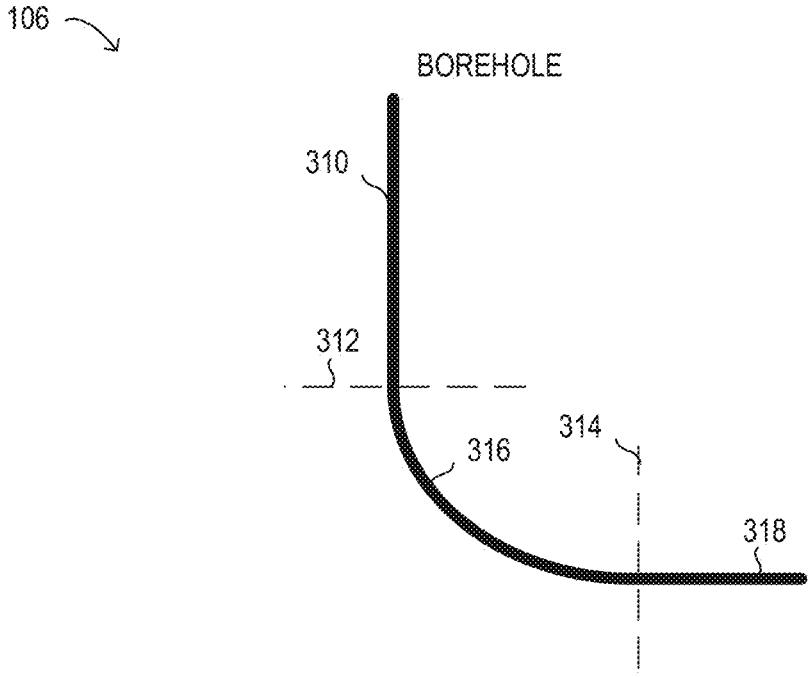
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination angle in buildup section 316 per measured length drilled is referred to herein as a "build rate" and may be defined in degrees per one hundred feet drilled. For example, the build rate may have a value of 6°/100 ft., indicating that there is a six degree change in inclination angle for every one hundred feet drilled. The build rate for a particular build up section may remain relatively constant or may van.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination angle, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and re-drilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form borehole 106. Rotating, also called "rotary drilling." uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of drill string 146. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of borehole 106. Once the desired orientation of the mud motor is attained. WOB to the drill bit is increased, which causes the drill bit to move in the desired direction of deviation. Once sufficient distance and angle have been built up in the curved trajectory, a transition back to rotating mode can be accomplished by rotating drill string 146 again. The rotation of drill string 146 after sliding may neutralize the directional deviation caused by the bend in the mud motor due to the continuous rotation around a centerline of borehole 106.

Figure 4:
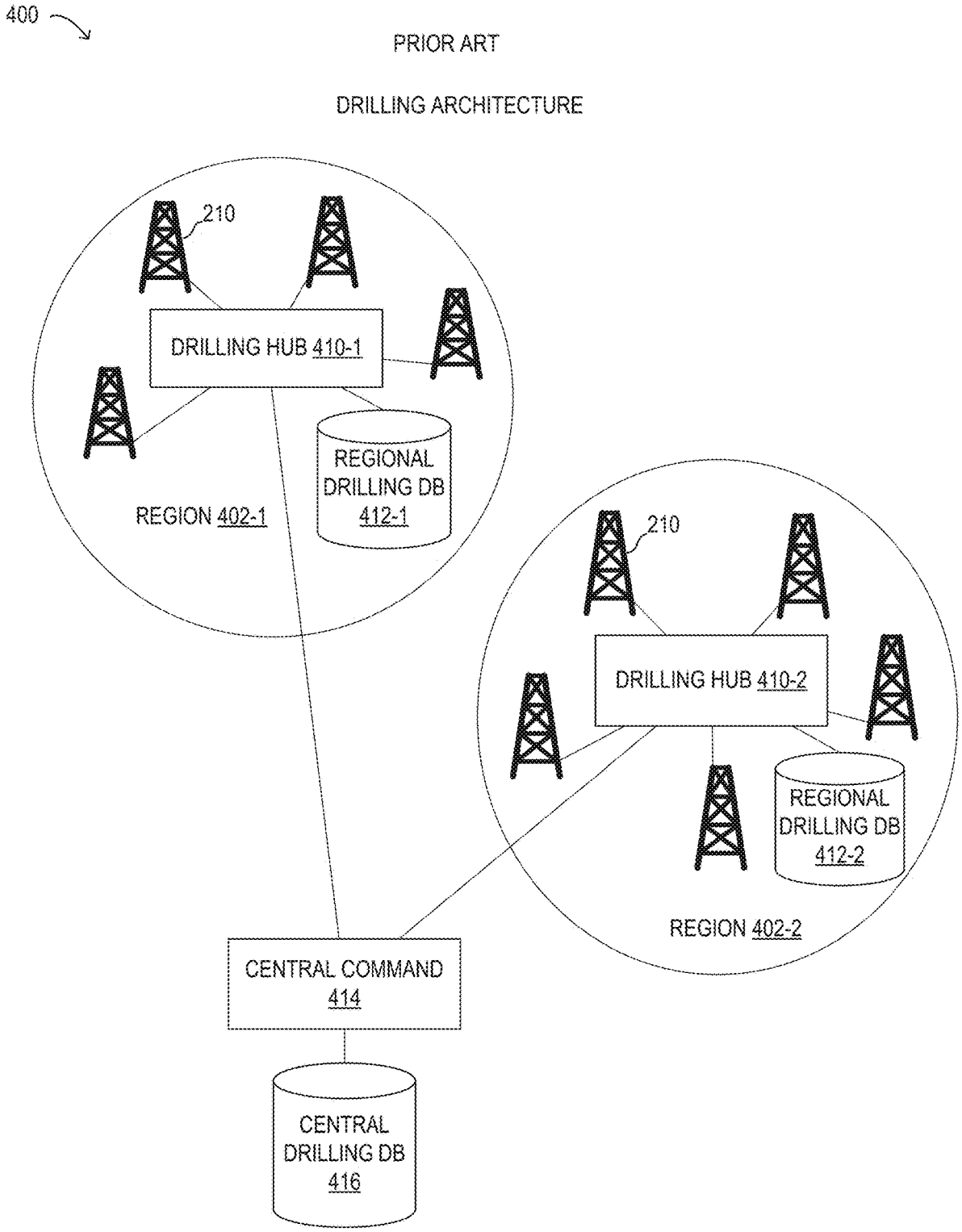
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 402-1, a drilling hub 410-1 may serve as a remote processing resource for drilling rigs 210 located in region 402-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 402-2, a drilling hub 410-2 may serve as a remote processing resource for drilling rigs 210 located in region 402-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
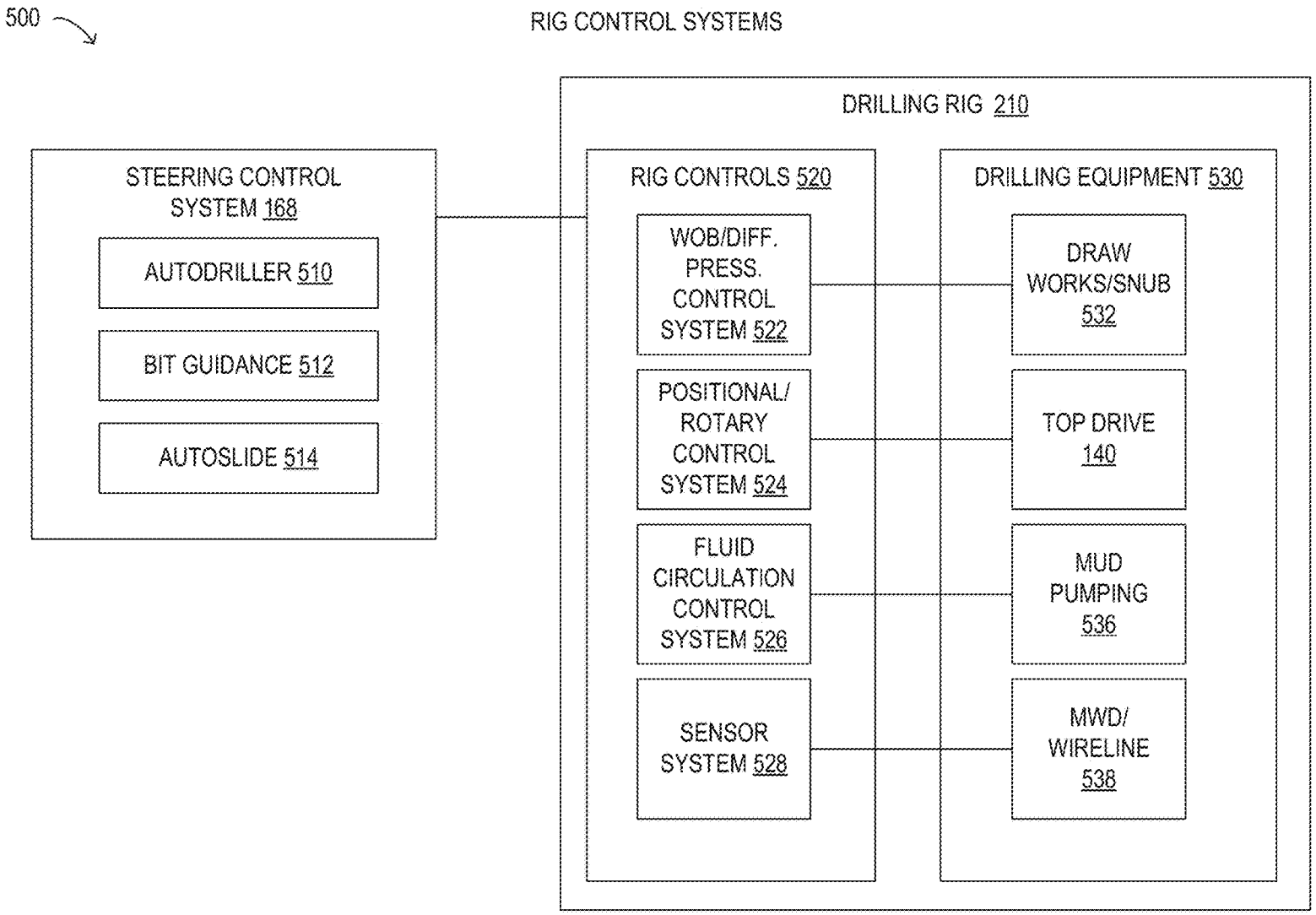
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, a mud pumping 536, and an MWD/wireline 538.

Figure 10:
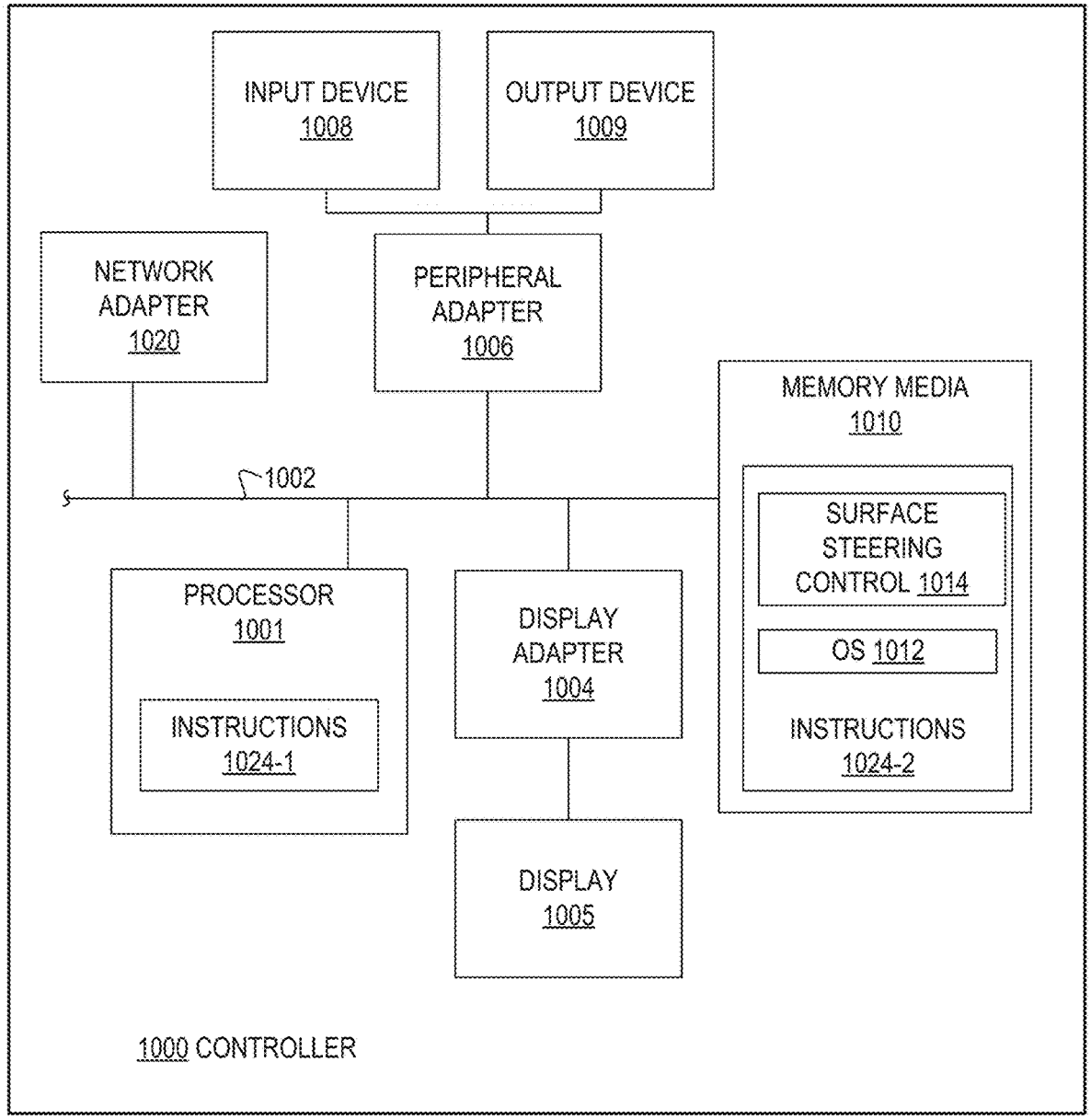
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide and may retum control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a tool face and on autodriller 510 to set WOB or control rotation or vibration of drill string 146.

Figure 6:
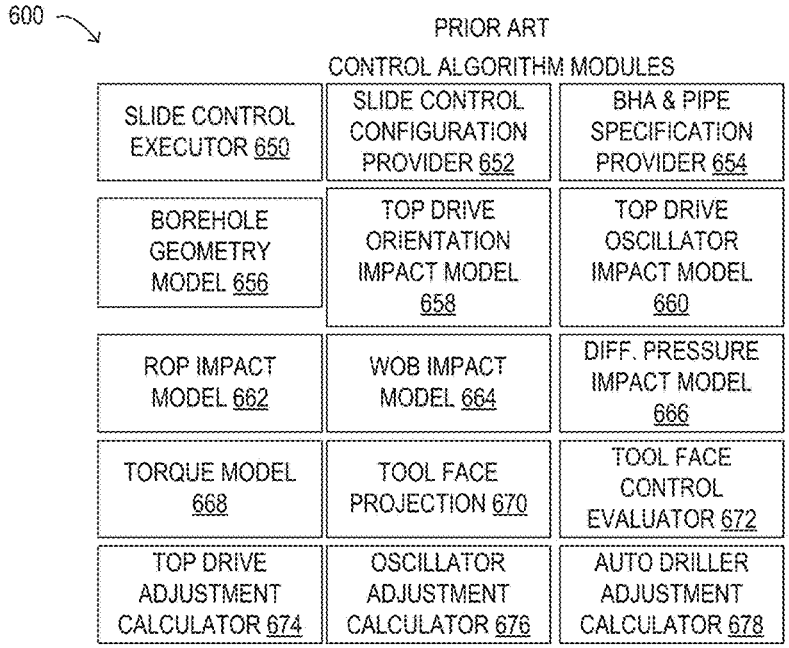
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the tool face control; a top drive oscillator impact model 660 that is responsible for modeling the impact that oscillations of top drive 140 has had on the tool face control, an ROP impact model 662 that is responsible for modeling the effect on the tool face control of a change in ROP or a corresponding ROP set point; a WOB impact model 664 that is responsible for modeling the effect on the tool face control of a change in WOB or a corresponding WOB set point; a differential pressure impact model 666 that is responsible for modeling the effect on the tool face control of a change in differential pressure (DP) or a corresponding DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
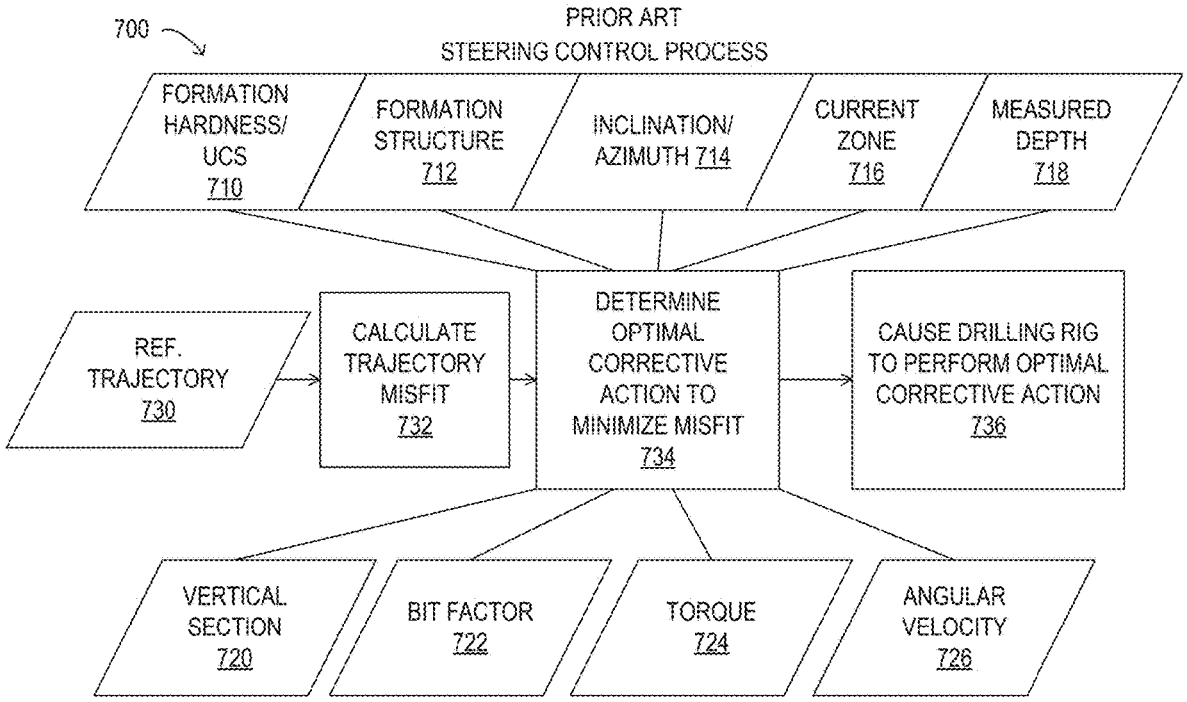
FIG. 7 is a depiction of a steering control process used by the rig control systems.

FIG. 7 illustrates one embodiment of a steering control process 700 for determining a corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine a corrective action to minimize the misfit at step 734, which may be performed using the other inputs described above. Then, at step 736, the drilling rig is caused to perform the corrective action.

It is noted that in some implementations, at least certain portions of steering control process 700 may be automated or performed without user intervention, such as using rig control systems 700 (see FIG. 7). In other implementations, the corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
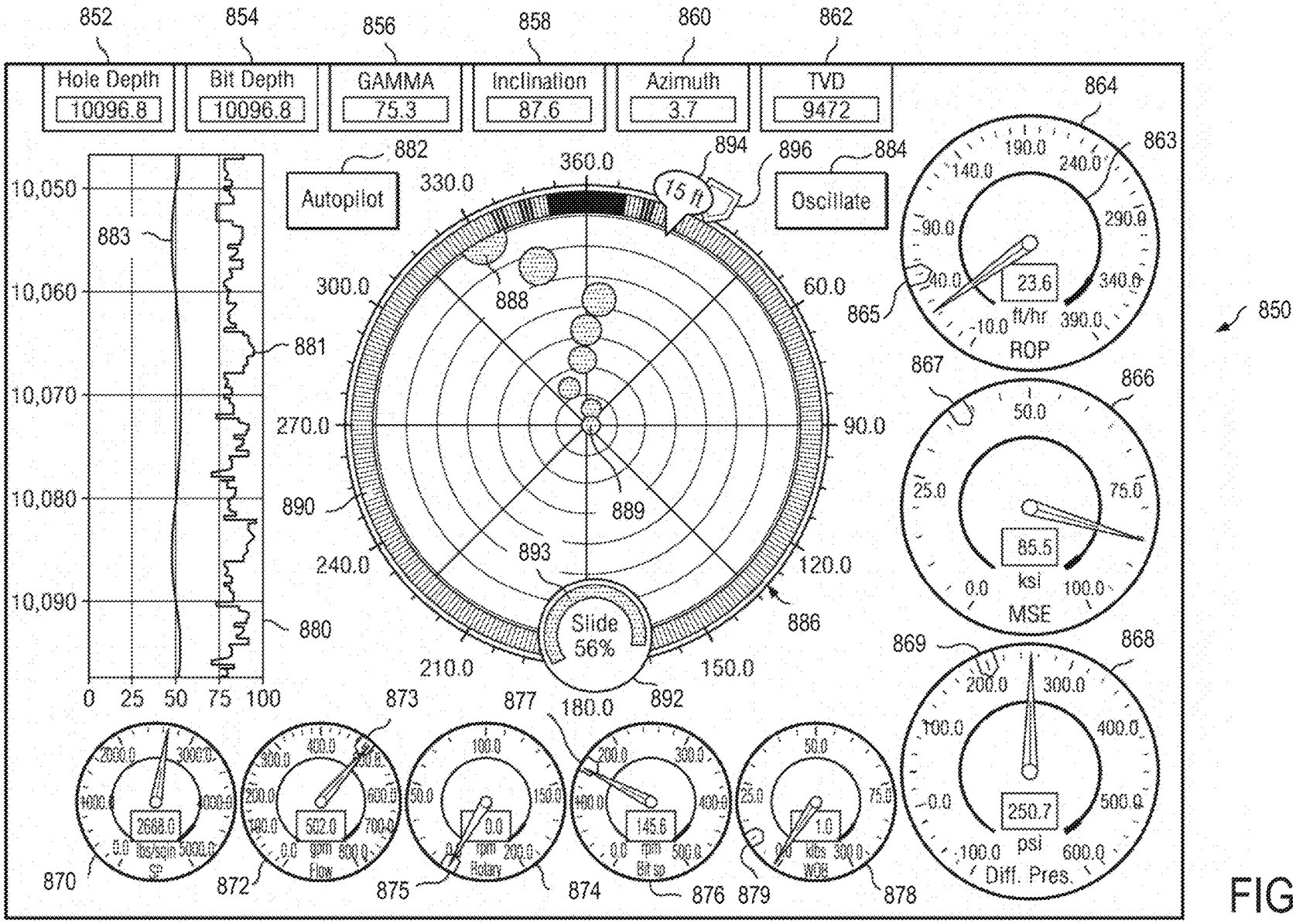
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 kilo-pounds per square inch (ksi) (or 255 MegaPascals (MPa)). Differential pressure indicator 868 may include a marker 869 indicating that the target value is 200 psi (or 1.38 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gallons per minute (gpm) (or 31.5 Liters per second (L/s)). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 kilo-pounds (klbs) (or 4.500 kilograms (kg)). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warmings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
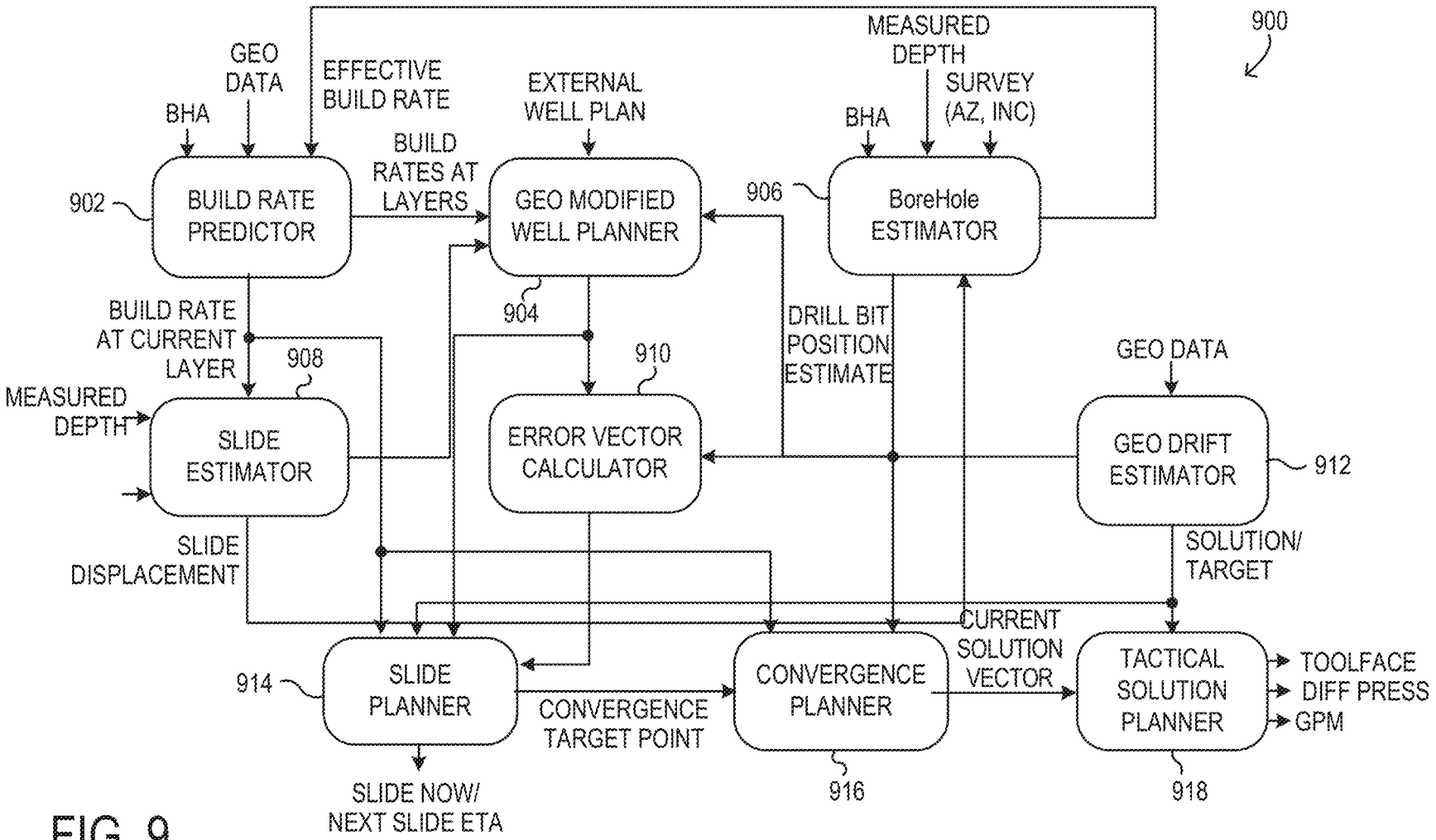
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good tool face and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912 and provides output to slide planner 914 and error vector calculator 910. Geo modified well planner 904 uses the input to determine whether there is a more desirable trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination angle as a set point for steering control system 168 to control. For example, the geologist may enter a target to steering control system 168 of 90.5-91.0 degrees of inclination angle for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing BHA information, measured depth information, survey information (e.g., azimuth angle and inclination angle), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each tool face update may be algorithmically merged with the average differential pressure of the period between the previous and current tool face readings, as well as the MD change during this period to predict the direction, angular deviation, and MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost calculation and plan for sliding activity, which may include factoring in BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50 foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in drill string 146. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to a desired tool face orientation. While not all downhole tools may provide tool face orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and desired convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay, or planned for implementation at a future time that is specified in advance.

In FIG. 9, tactical solution planner 918 receives internal inputs from geological drift estimator 912 and convergence planner 916 and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole tool face. Accordingly, GCL 900 may receive information corresponding to the rotational position of the drill pipe on the surface. GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 900. The drill bit model may represent the current position and state of drill bit 148. The drill bit model may include a three dimensional (3D) position, a drill bit trajectory, BHA information, bit speed, and tool face (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum rotations per minute (RPMs) to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television, or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows®, family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

The following disclosure explains additional and improved methods and systems for drilling. In particular, the following systems and methods can be useful to drill deeper wells, especially through harder rock formations, faster and more efficiently than with conventional drilling techniques. It should be noted that the following methods may be implemented by a computer system such as any of those described above. For example, the computer system used to monitor, perform and/or control the methods described below may be a part of the steering control system 168, a part of the rig controls system 500, a part of the drilling system 100, included with the controller 1000, or may be a similar or different computer system and may be coupled to one or more of the foregoing systems. The computer system may be located at or near the rig site or may be located at a remote location from the rig site and may be configured to transmit and receive data to and from a rig site while a well is being drilled. Moreover, it should be noted that the computer system and/or the control system for controlling the flow of fuel and/or drilling mud may be located downhole in some situations.

DETAILED DESCRIPTION OF THE INVENTION

Bitless Drilling

Drilling deep underground can be expensive, often in part due to the trip time needed when a drill bit and/or its cutters wear out. Drilling in harder rock formations further increases the costs of drilling because the bit wears out more easily and more quickly when drilling through harder formations. For example, in drilling a wellbore in a typical deep, granite formation, a drill bit may last for 1,000 feet (ft) of the wellbore measured depth. The trip time typically can be around one hour per thousand feet of drill pipe. Thus, drilling through 10,000 ft of a granite formation that starts at 20,000 ft depth will likely involve 10 return trips to replace worn out bits with an average time of 50 hours for each trip. If the rate of penetration of the on-bottom time of the bit is 20 ft per hour, a drilling plan for this formation for this 10,000 ft alone would account for approximately 500 hours of drilling and 500 hours of tripping time.

The following systems and techniques can be used to reduce the time required to drill in such deep formations. In some embodiments, a drill bit need not be used to drill the wellbore or portions thereof, and instead such portions of the wellbore can be "drilled" with the use of a combustible material, such as a slow burning rocket fuel. We believe that the use of a combustible material such as rocket fuel may achieve a rate of penetration (ROP), even though harder rock formations, as much as 100 ft per hour. Because the use of such a combustible material does not require the use of a drill bit that may wear out, it is anticipated that no time will be needed for tripping out (such as to replace the bit). By drilling with the slow burn rocket fuel or other combustible material, it is believed that the rig time costs can be reduced by a factor of as much as 10 in appropriate situations. The cost of the fuel needed for such drilling should easily be overcome by the time savings achieved.

While any appropriate combustible material may be used in connection with the present disclosure, the following discussion focuses on using a slow burn rocket fuel. It is believed that such a fuel can be used to burn through materials (such as steel) that have high melting points, such as around 1500° C. It is believed that such a fuel should easily be able to burn through most rock formations encountered in most drilling situations. For example, in the presence of a fluid, granite has a melting point of around 700° C. We believe that the rocket fuel should be able to melt and burn through a granite formation with relative ease in accordance with the systems and methods of the present disclosure.

Figure 11:
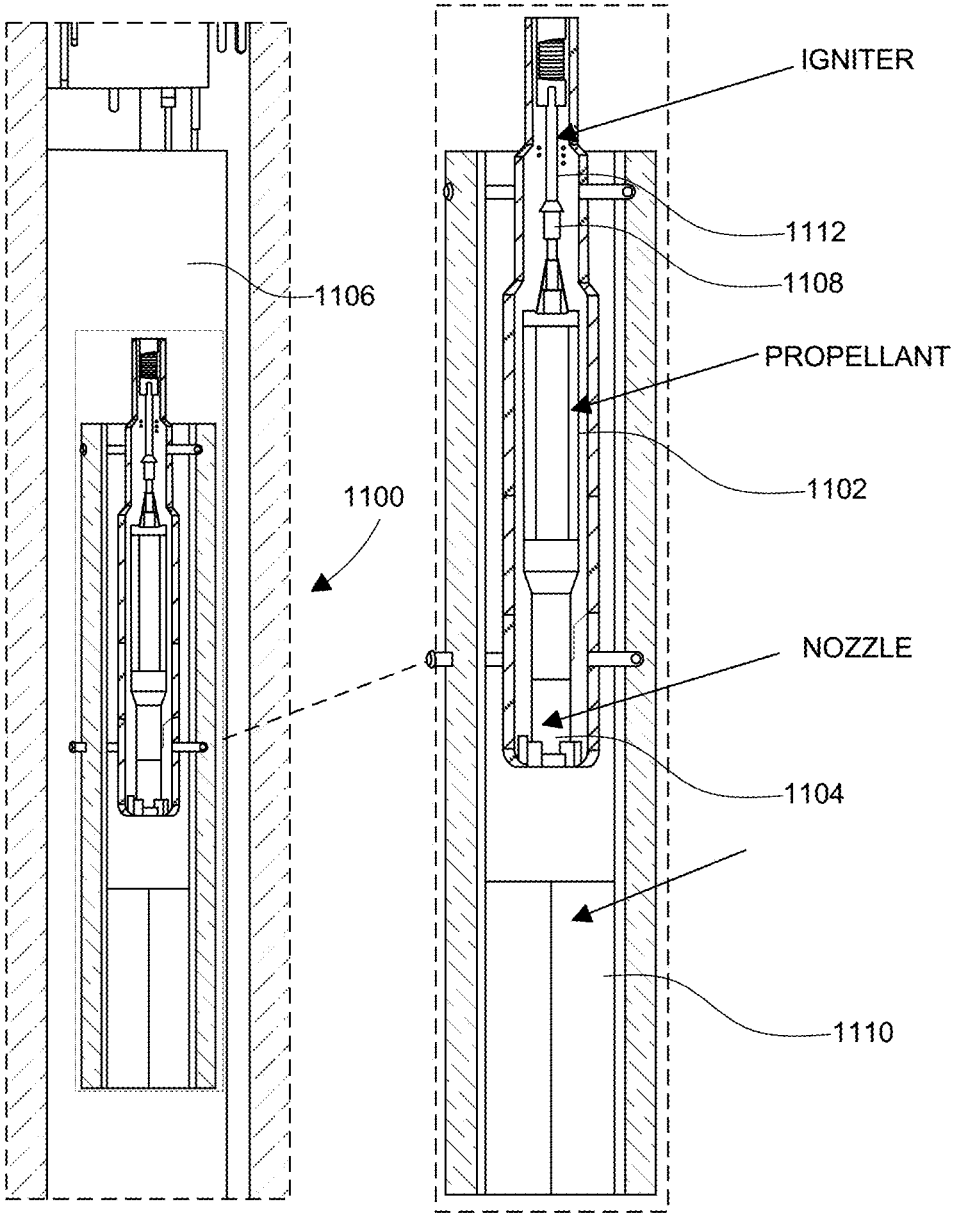
FIG. 11 illustrates a bitless drilling assembly.

FIG. 11 illustrates a bitless drilling assembly 1100. The bitless drilling assembly can include an apparatus for drilling. (It should be noted that this specification uses the term "drilling" to apply to advancing the wellbore in a manner that does not require a drill bit and does not require boring in the usual sense of the term "drilling." For convenience, however, the term "drilling" is used to describe the advancement or creation of the wellbore.) The bitless drilling assembly 1100 can include a propellant chamber 1102 configured to store a liquid propellant for drilling. In various embodiments, the liquid propellant can include hydrazine, monomethylhydrazine, unsymmetrical dimethylhydrazine, dinitrogen tetroxide, and/or combinations of the foregoing. The bitless drilling assembly 1100 can include a burner nozzle 1104 connected to the propellant chamber 1102 via one or more passages (not shown) to route the liquid propellant from the propellant chamber 1102 to the burner nozzle 1104. The burner nozzle 1104 can be at the lowest point in the bitless drilling assembly 1100. The propellant tank 1102 can be above the burner nozzle 1104 so gravity can be used to feed liquid propellant from the propellant tank 1102 to the burner nozzle 1104. The bitless drilling assembly 1100 can include an ignitor 1112 configured to ignite the liquid propellant as the liquid propellant escapes the burner nozzle 1104. In various embodiments, the burner nozzle 1104 can be formed with a high temperature, high abrasion ceramic material.

In various embodiments, the bitless drilling assembly 1100 can include a connector 1108 for coupling a propellant feed hose to the propellant tank 1102. The propellant can be fed into the drilling fluid by a single hose line which can be rapidly recovered along with the burner without tripping drill pipe out of the hole. In one approach, the propellant feed hose would be connectable in 90 ft sections and fed through each stand of drill pipe as the stands are added to the drill string before making pipe connections at a surface of the borehole.

Figure 12:
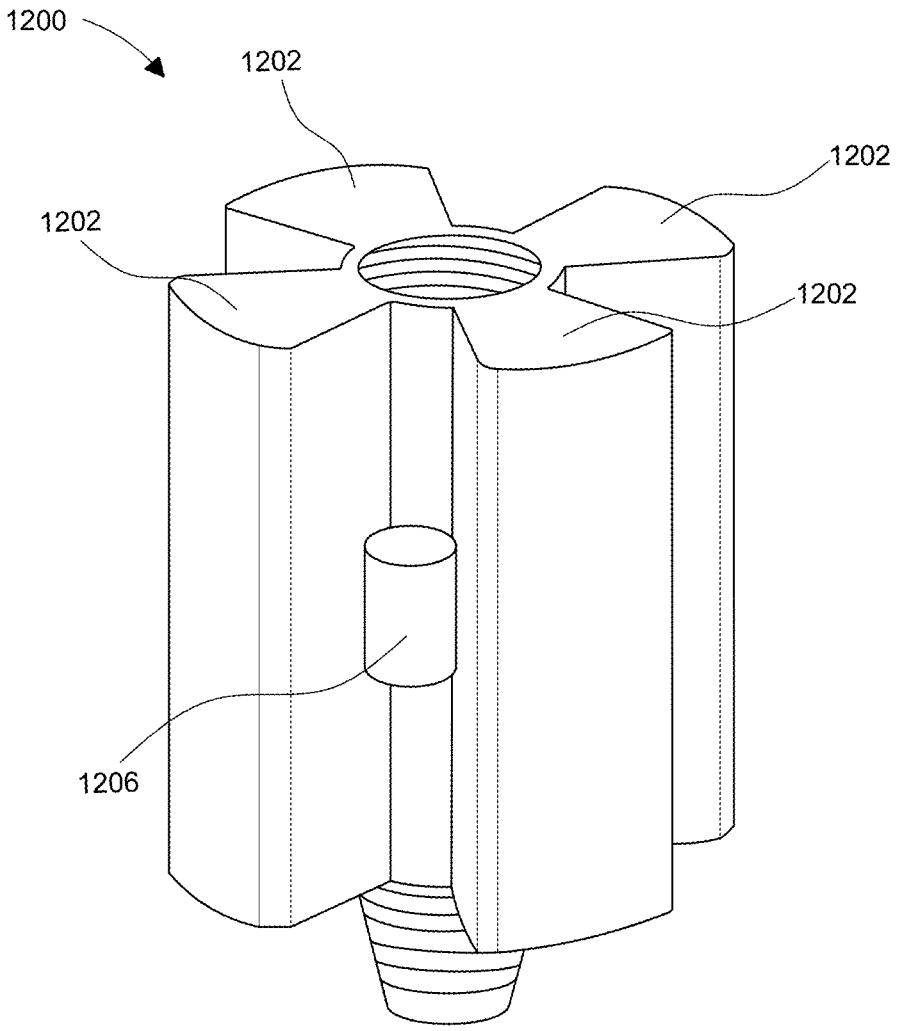
FIG. 12 illustrates a protector sub and a hose clip for use in a bitless drilling assembly.

When a hose is used to deliver the fuel to the nozzle, it may be beneficial to avoid having the hose get rolled over by drill pipe. In one embodiment, a protector sub 1200 between the pipe joints can be used to help hold the hose in place and avoid pinching or deformation from contact with the drill pipe. FIG. 12 illustrates an example of such a protector sub 1200. In FIG. 12, a holder 1206 is shown between two fins 1202 or projections from the center of the protector sub 1206. The holder 1206 can be used to securely hold the hose in place between the fins 1202, which help protect the hose against unwanted contact and damage or deformation.

Figure 13:
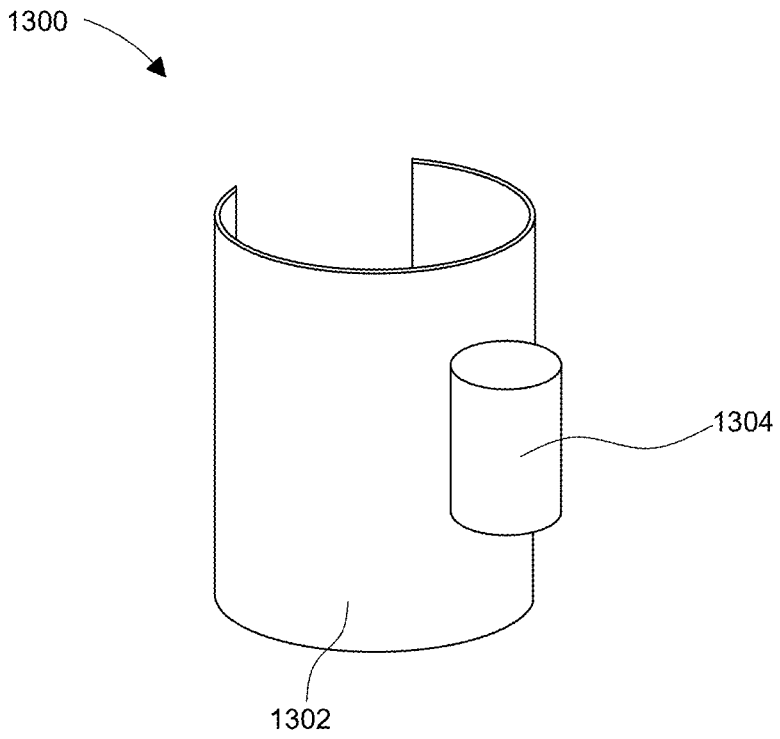
FIG. 13 illustrates a hose clip for use in a bitless drilling assembly.

In addition or alternatively, one or more hose clips 1302 atone or more locations along the length of a pipe or a stand (e.g., near the center of each pipe in the drill string) can be used to hold the hose in a fixed location relative to the pipe. FIG. 13 illustrates an example of such a hose clip. As shown in FIG. 13, a hose holder 1304 is located on the outside of the hose clip 1302 that is adapted to fit snugly on the outside of the drill pipe. If the hose clip 1302 extends only partially around the outside of the drill pipe, it can be more easily clipped to and removed from the pipe and can also be more easily moved so that the hose is located in a desired location with respect to the circumference of the drill pipe. It is desirable to allow easy positioning of the one or more hose clips 1302 to help align the hose, but once the hose clip 1302 is in place on the pipe it would be advantageous to also have some traction or engagement method to avoid having the hose winding around the pipe. Various means to reduce or prevent such winding of the hose may be used, such as applying a high friction coating to the exterior surface of the pipe (which may the entire surface or only a portion thereof), providing a metal surface treatment like knurling, or could involve providing teeth or splines on the exterior surface of the drill pipe to prevent or reduce rotation of the hose relative to the pipe.

Figure 14:
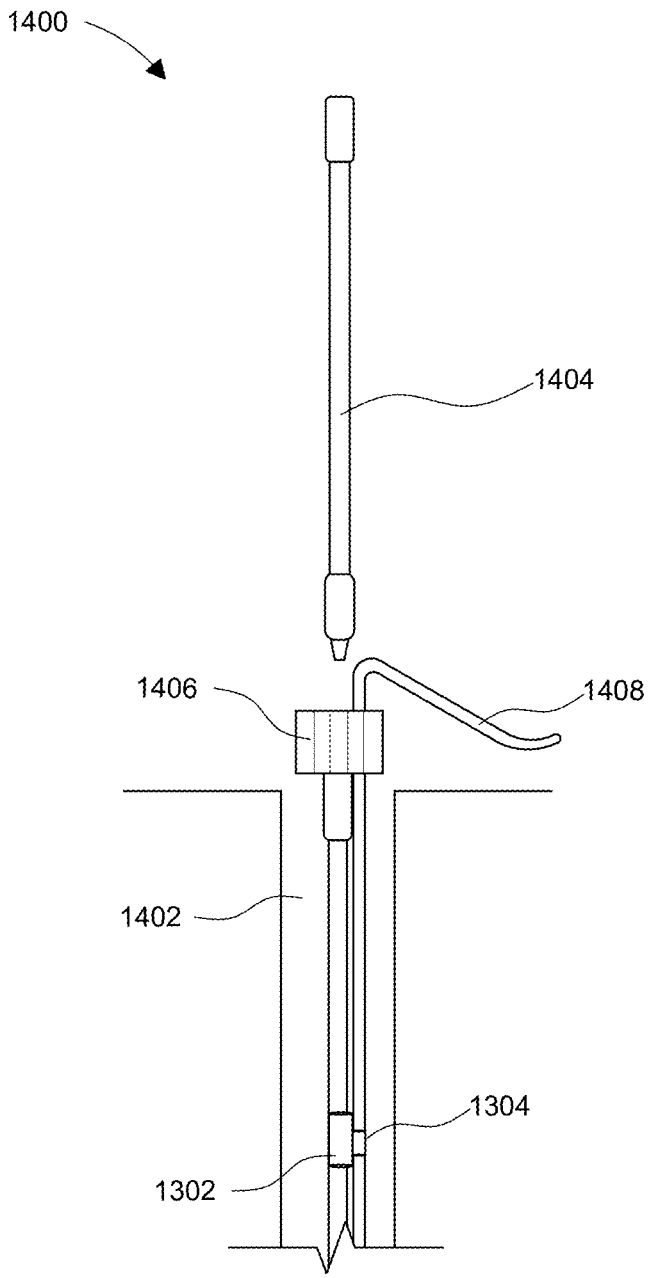
FIG. 14 illustrates a bitless drilling assembly with a protector sub and a hose clip.
Figure 15:
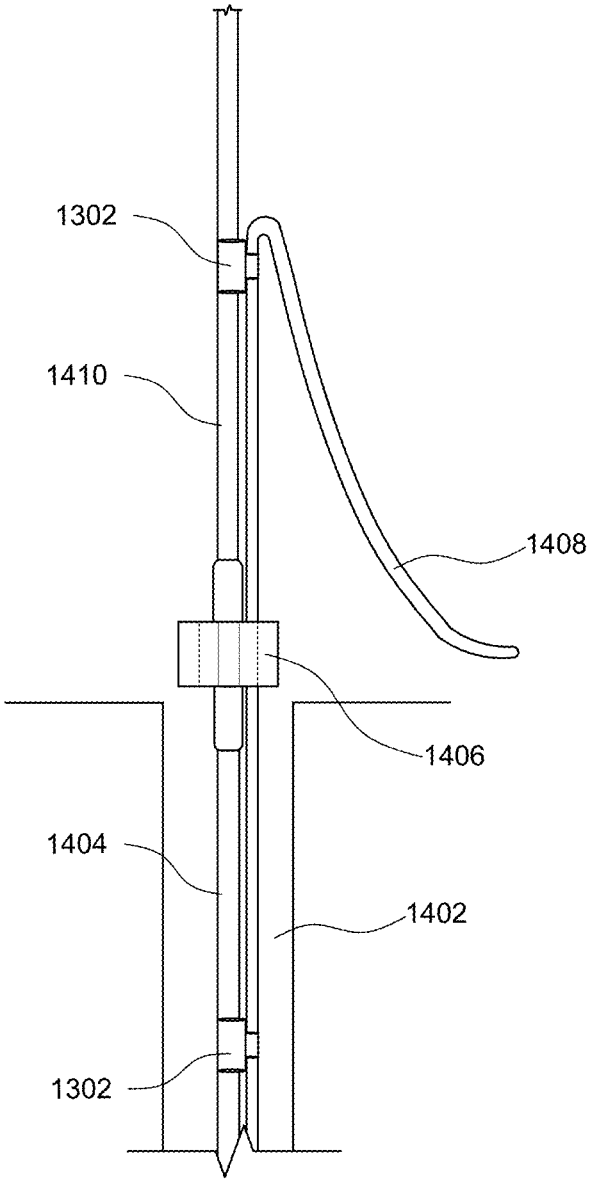
FIG. 15 illustrates the bitless drilling assembly of FIG. 14 as assembled.

Referring now to FIGS. 14 and 15, the combined use of a hose clip 1302 and a sub protector 1406 is illustrated. In FIG. 14, a pipe 1404 with a hose 1408 clipped thereto and extending through a protector sub 1406 is shown partially located in a wellbore 1402, with an additional piece of pipe 1410 above the same to be added thereto. In FIG. 15, the additional piece of pipe 1410 with a hose clip 1302 attached thereto (and with a hose 1408 extending therethrough) is shown as attached to the pipe 1404 in the wellbore 1402. The protector sub 1406 connects the two pieces of pipe 1404, 1410 together and the hose 1408 extends between the projecting fins 1202 (as shown in FIG. 12) of the protector sub 1406.

Figure 16:
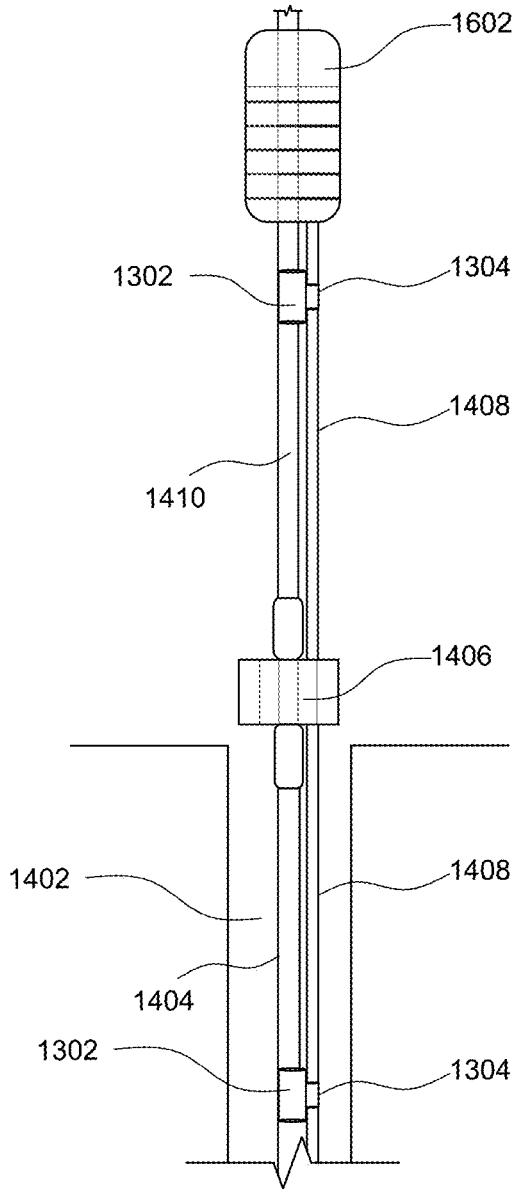
FIG. 16 illustrates a bitless drilling assembly with a fuel reservoir.
Figure 17:
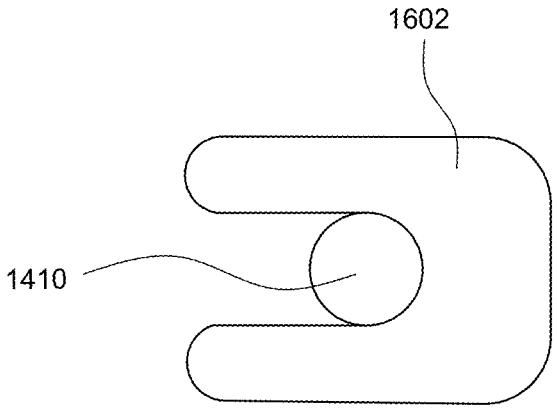
FIG. 17 illustrates the fuel reservoir of FIG. 16.

In yet another embodiment, such as illustrated in FIGS. 16 and 17, one or more fluid reservoirs 1602 can be connected to a hose 1408 for delivery of the drilling fuel. In FIG. 16, the reservoir 1602 is illustrated at the top of the upper pipe 1410 in an assembly of a plurality of pipes, one of which is at least partially located in a wellbore 1402. As shown in FIG. 16, a first, upper end of the hose 1408 is attached to a bottom side of the reservoir 1602, with the hose 1408 extending therefrom through a hose holder 1304 clipped to the upper pipe 1410, then through a protector sub 1406, and then through yet another hose holder 1304 clipped to the lower pipe 1404 shown in FIG. 16. It should be appreciated that "top" and "bottom" and "upper" and "lower" are terms used for convenience with respect to the illustrations in FIGS. 16 AND 17, and that the drill string (and hence the pipe 1404, 1410 and the hose 1408, etc.) may in fact be disposed in a direction that does not correspond to the use of such terms in connection with the Figures due to the fact that directional wells may extend in several directions along the length of the wellbore 1402. Although not shown, it should be noted that the fuel delivery reservoirs 1602 could each contain a pressurized chamber, a spring loaded plunger, or other devices responding to flow of the fuel such as a venturi effect to control and/or induce fuel travelling to the BHA, or to reduce the flow of fuel if desired. These devices can be actuated and/or controlled from the surface or can be purely passive in nature to provide the amount of fuel required, such as may be determined by a control system like that described herein.

In FIGS. 16 and 17, the fuel reservoir 1602 is essentially horseshoe shaped and may be connected sideways to the drill pipe 1410 and descends with the rest of the pipe 1410 and the drillstring into a wellbore 1402. At the 90 ft pipe connections (i.e., usually considered a "stand" of pipe), the fuel reservoir 1602 can be refilled, an additional hose connected thereto and primed, and the reservoir removed and relocated at the top of the stand. Although this procedure might seem to involve additional steps, we believe that there may be ROP advantages with the use of the combustion fuel for drilling that will justify the additional procedures involved with the use of such one or more reservoirs 602 for the fuel.

Figure 18:
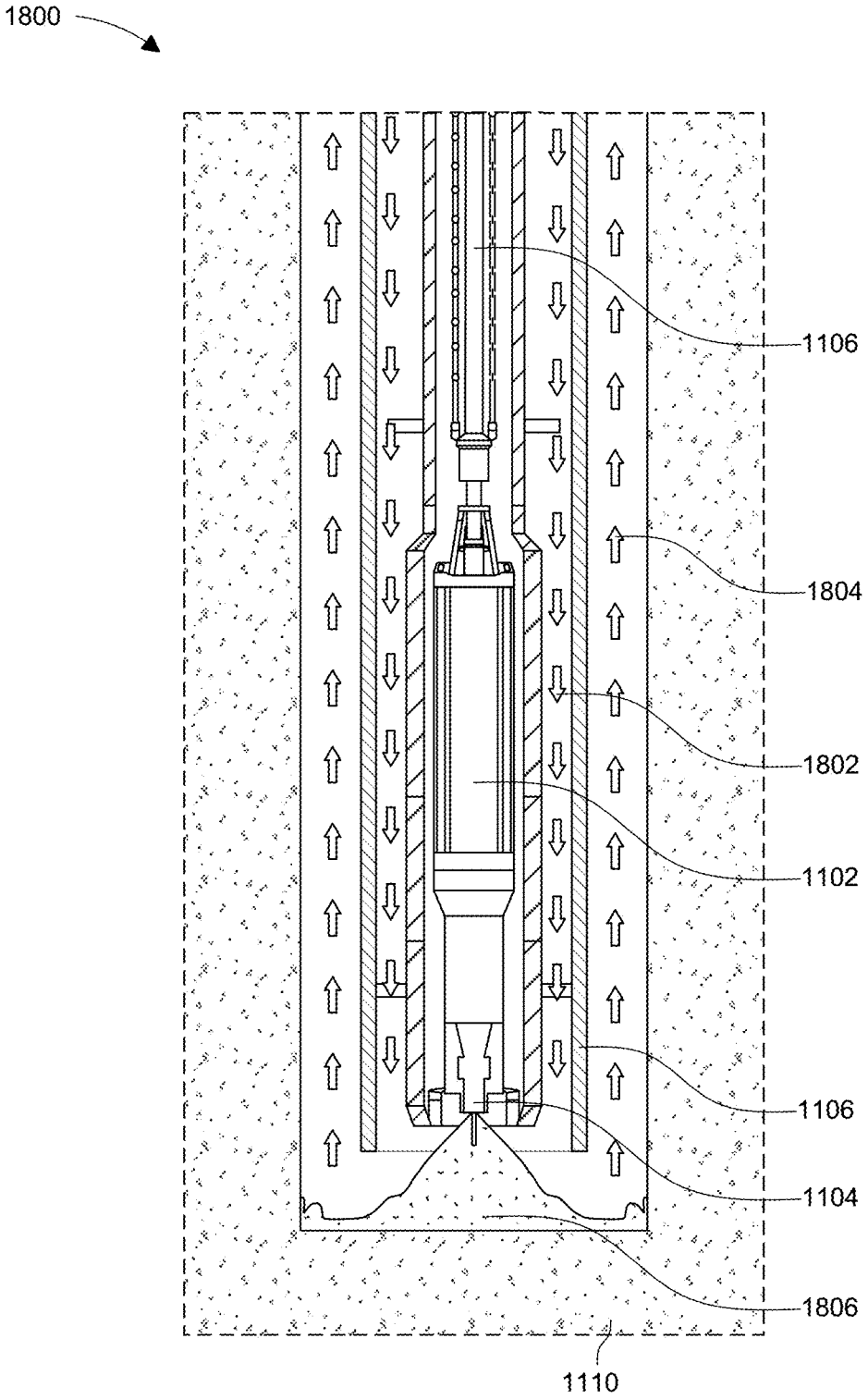
FIG. 18 illustrates a second embodiment of a bitless drilling assembly.

FIG. 18 illustrates a second embodiment of a bitless drilling assembly 1800 encased within a drill pipe 1106. In various embodiments, the burner nozzle 1104 can be encased in a drill pipe 1106 to create a path for a drilling fluid that bypasses the burner nozzle 1104 and feeds fluid down an inside annular passage 1802 between the drill pipe and the assembly 1800. The assembly 1800 may include passageways (not shown) to help direct the fuel towards the burner nozzle, and/or reduce the size of the opening (to increase the pressure at which the fuel is presented to the burner) or provide a series of small openings (to decrease droplet size and increase the surface area of the fuel as presented to the burner nozzle 1104). The unspent fuel, drilling mud, and rock residue can be removed from the wellbore and go up to the surface via an outside annular passage 1804 between the drill pipe 1106 and the wellbore. In various embodiments, the drill pipe 1106 can include a large internal diameter drill pipe. FIG. 18 illustrates the use of a liquid propellant 1806 exiting the nozzle 1104 and drilling a formation 1110.

Figure 19:
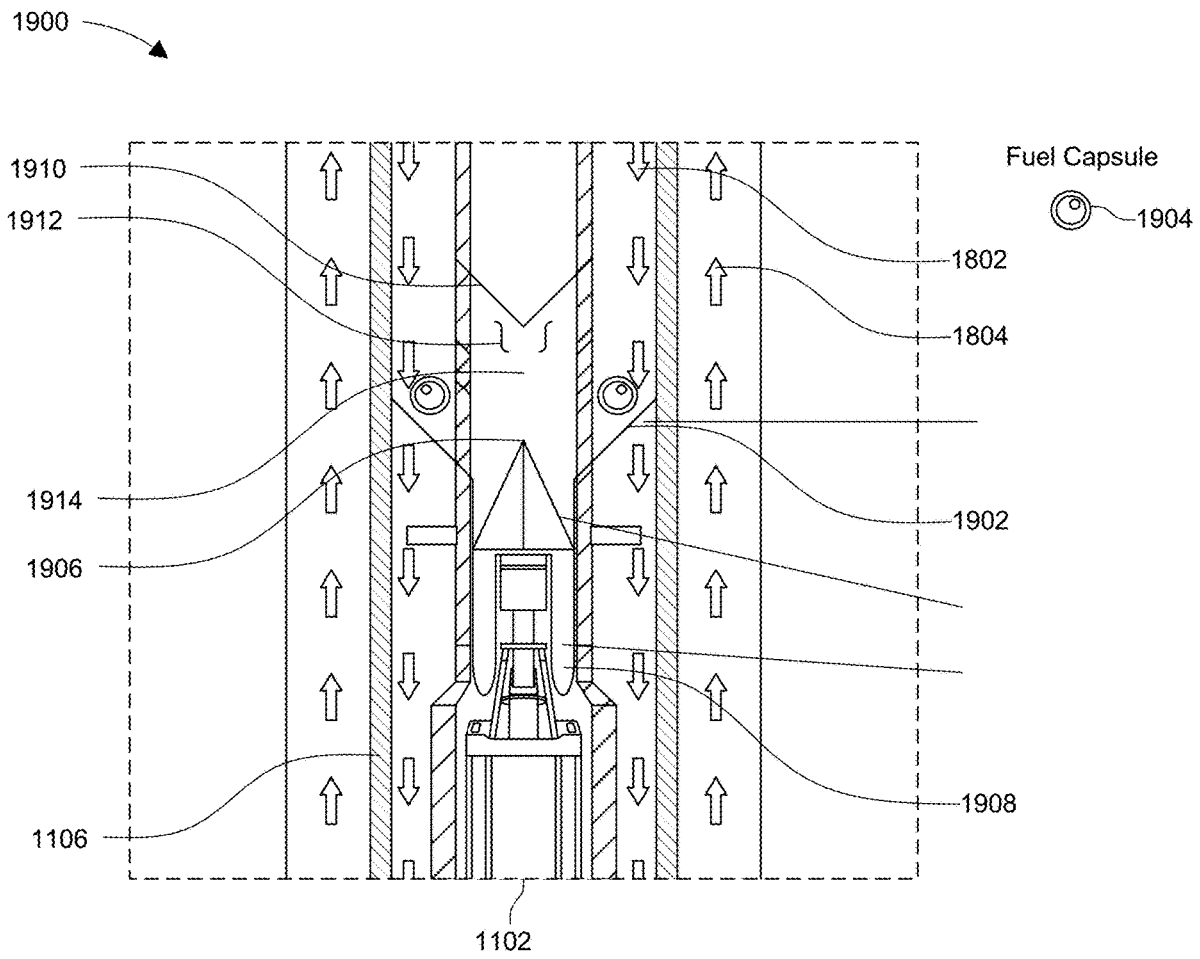
FIG. 19 illustrates a third embodiment of a bitless drilling assembly.

FIG. 19 illustrates a third embodiment of a bitless drilling assembly 1900. In this embodiment, there would be no need for a propellant feed hose. The propellant can be fed into the drilling fluid in the form of one or more propellant capsules 1904. This avoids the need for providing a hose or pipe to provide fuel to the assembly downhole, and thus avoids the need for potential connecting segments of hoses to extend through the drill string.

In various embodiments, the bitless drilling assembly 1900 can include a diverter cage 1902 placed in a path of the inside passage 1802 to divert the one or more propellant capsules 1904 from the inside passage 1802 to a capsule blade 1906. The capsule blade 1906 can be configured to puncture the one or more propellant capsules 1904. The bitless drilling assembly 1900 can include a reservoir 1908 configured to capture the liquid propellant released from the one or more propellant capsules 1904 and route the liquid propellant to the propellant chamber 1102.

The one or more propellant capsules 1904 may contain fuel having a greater specific gravity (e.g., 1.4) that is held within plastic capsules with a lower specific gravity (e.g., 0.9). The one or more propellant capsules 1904 can be fed down the drill pipe and around the burner housing and can be diverted by a diverter cage 1902 with a mesh size smaller than the capsule diameter (at pressure). Once inside the burner chamber, they are punctured by a capsule blade 1902 and the released propellant drops into the fuel reservoir 1908. The spent capsules 1912 float up and out into the flow 1914 and escape through the diverter cage 1902.

In various embodiments, the bitless drilling assembly 1900 can include a diverter 1910 configured to route one or more pierced capsule fragments 1912 to the outside passage 1804 of the drill pipe 1106.

Figure 20:
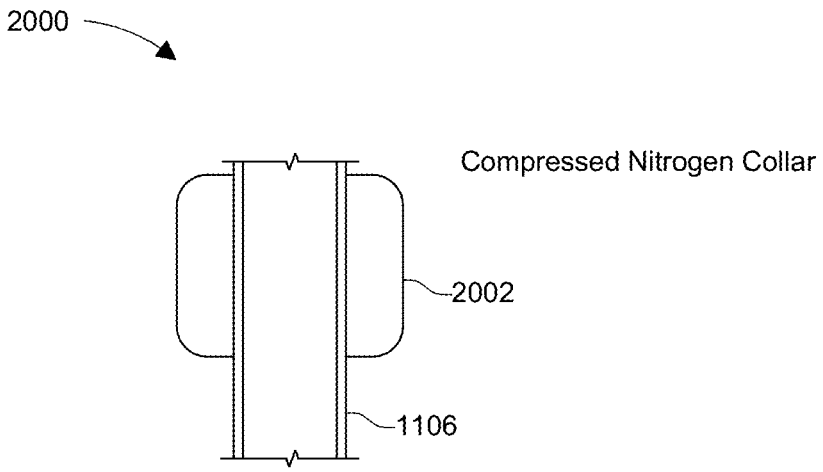
FIG. 20 illustrates a fourth embodiment of a bitless drilling assembly.

FIG. 20 illustrates a fourth embodiment of a bitless drilling assembly 2000. A further enhancement is to have the burner nozzle 1104 recognize when the nozzle is burned away and release compressed gas (e.g., nitrogen) into its own propellant chamber 1102. This would cause the whole bitless drilling assembly 2000 to float to surface and a replacement can then be dropped down into place. This could be done very simply by using the ceramic cylinder to also seal off a nitrogen pocket and when the burner nozzle 1104 is shortened to the extent it requires replacement, the bitless drilling assembly 2000 floats to surface.

In various embodiments, the bitless drilling assembly 2000 can include a burner nozzle monitor configured to detect a condition of the burner nozzle 1104. In various embodiments, the bitless drilling assembly 2000 can include a compressed gas cylinder 2002 coupled to the drill pipe, the compressed gas cylinder 2002 can be configured to release the compressed gas into a chamber to cause the bitless drilling assembly 2000 to float to a surface of a borehole if the burner nozzle 1104 is worn.

Figure 21:
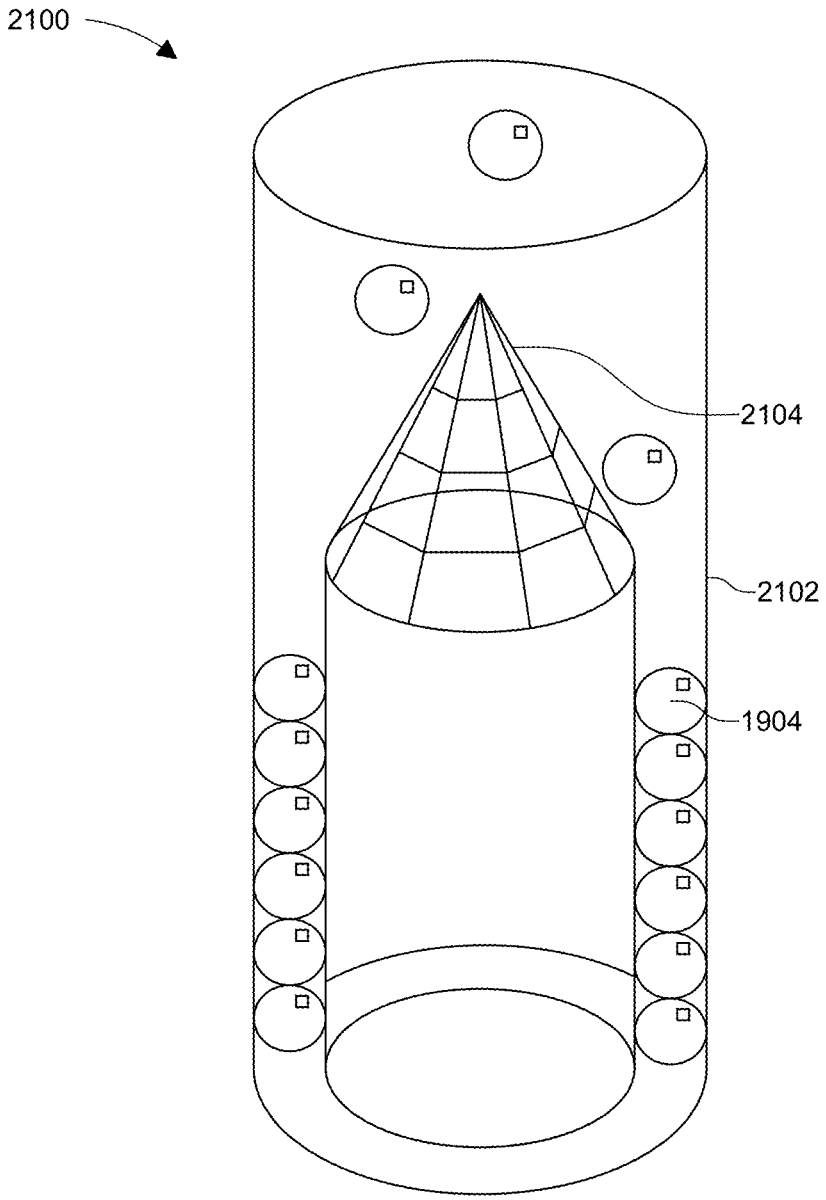
FIG. 21 illustrates a diverter in an outer sleeve of a bitless drilling assembly.

FIG. 21 illustrates a diverter in an outer sleeve 2102 of a bitless drilling assembly 2100. In various embodiments, the diverter cage 2104 comprises a mesh size smaller than a diameter of the one or more propellant capsules 1904. Additional fuel is in the one or more propellant capsules 1904 which can be diverted to an outer sleeve, crushed, and decontaminated to deliver more fuel to the burner nozzle 1104. The one or more capsules 1904 will sink in the drilling mud as fuel is denser than the drilling mud fluid.

Figure 22:
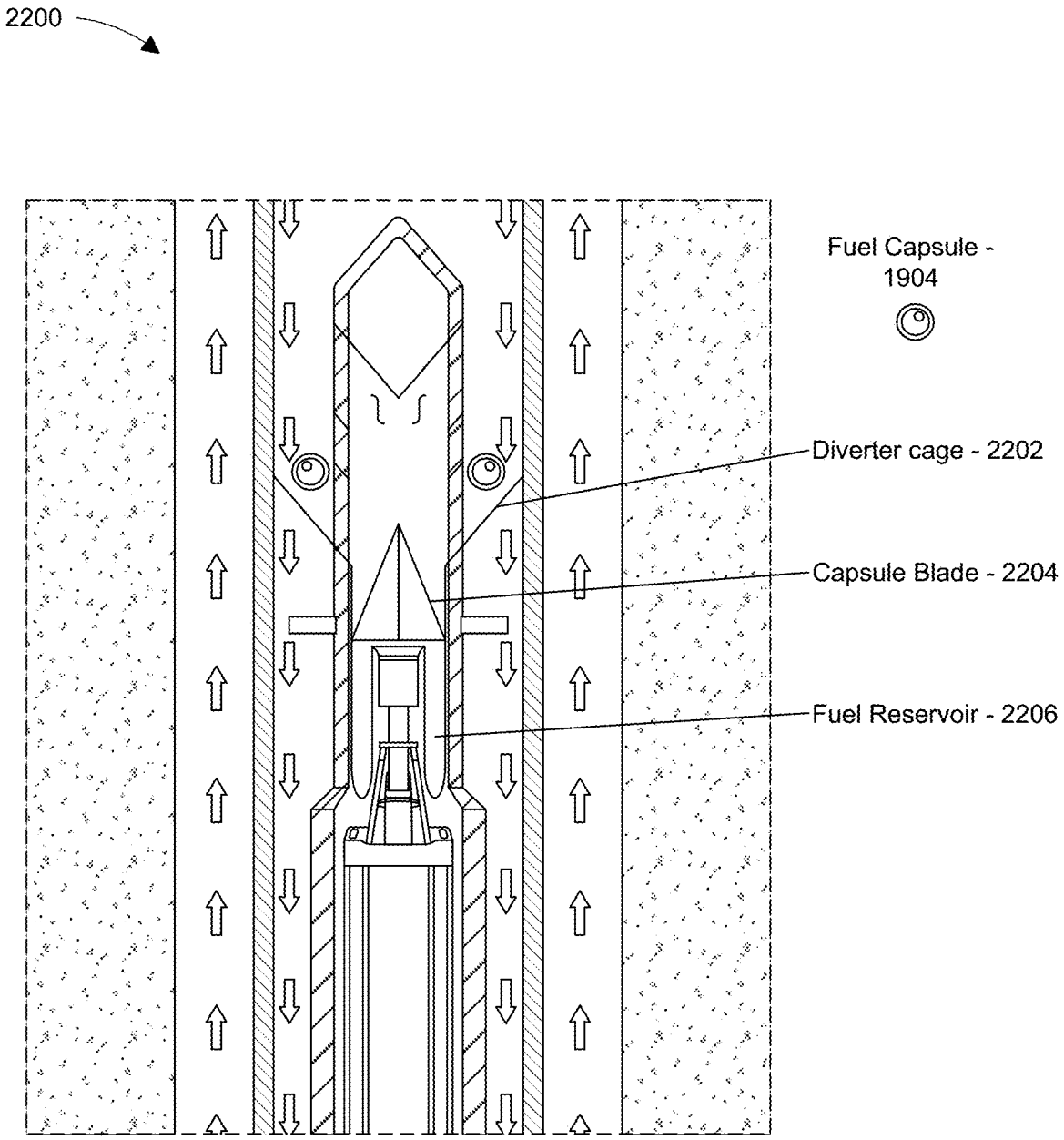
FIG. 22 illustrates an alternative fuel delivery system for a bitless drilling assembly.

FIG. 22 illustrates another embodiment of a fuel delivery system. In FIG. 21, the capsules 1904 comprise an outer layer made of a soft, thin material that has a first density, which may be less than the density of water and/or less than the density of drilling mud. The capsules 1904 descend in the drilling fluid because the overall density of each capsule 1904 is greater than the drilling fluid due to the density of the fuel in each capsule 1904. The capsules 1904 are diverted by an upwards facing conical cage (shown as the diverter cage 2202 in FIG. 22) into a fuel reservoir located within the drill string, where a sharp blade 2204 punctures and/or slices the capsule 1904. The fuel then drops into the reservoir 2206, while the punctured or sliced outer layer of the capsule 1904 then ascends back up into the flow of the drilling mud and is circulated out of the wellbore.

Figure 23:
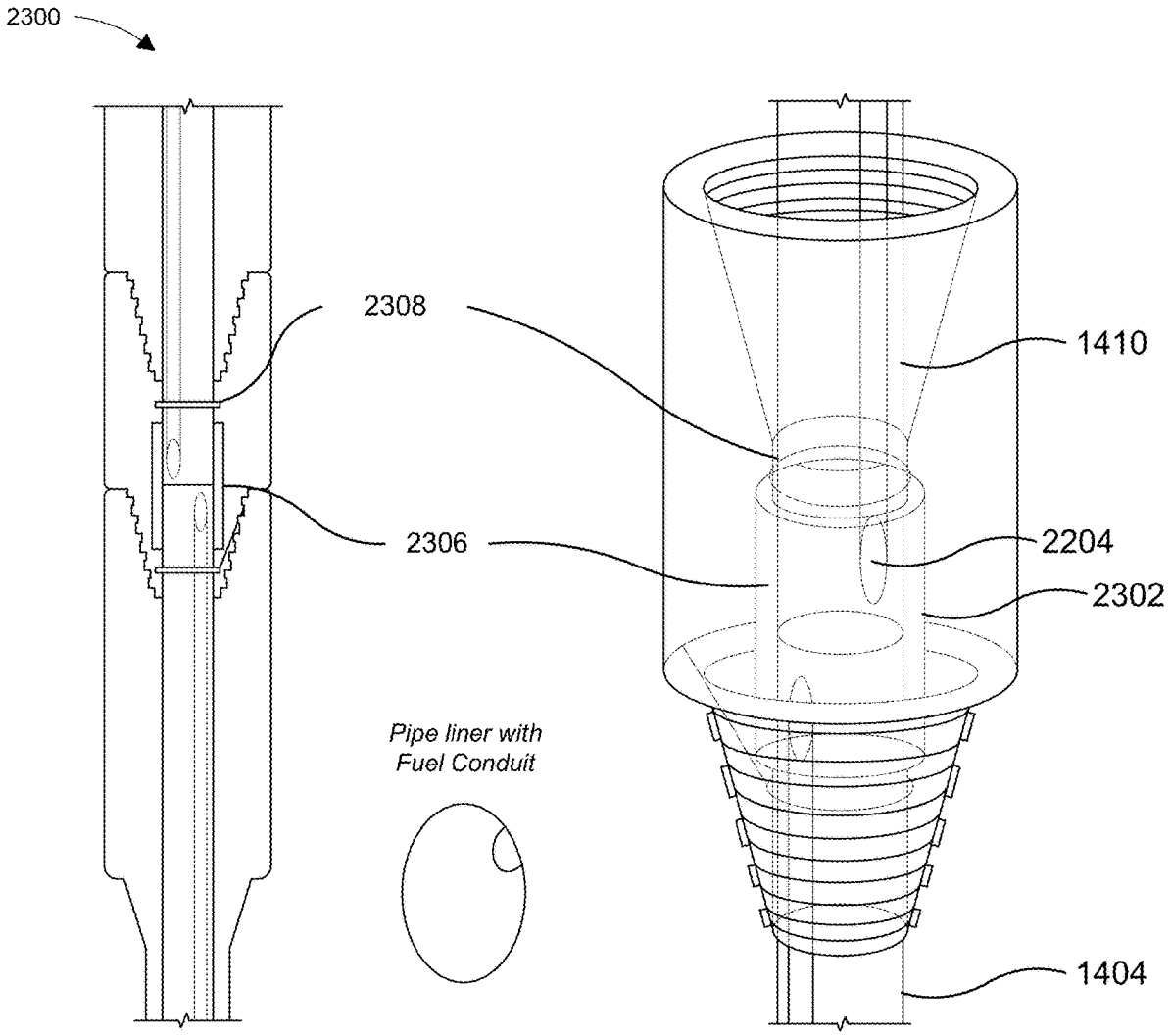
FIG. 23 illustrates an alternative fuel delivery system for a bitless drilling assembly.

In yet another alternative embodiment shown in FIG. 23, each piece of the drill pipe may be lined with a thin sleeve 2302 that has a conduit 2304 running from joint to joint of the drill pipe in the drill string in the wellbore. At each joint, a short sub is added and secured to one end of the two pipes joined together. The sub comprises a hollow ring chamber 2306 into which the conduits extend and open. A seal 2308 isolates the sleeve 2302 within the sub but the ring chamber 2306 allows fluid to flow easily from one pipe to the next regardless of the orientation of the connection.

Figure 24:
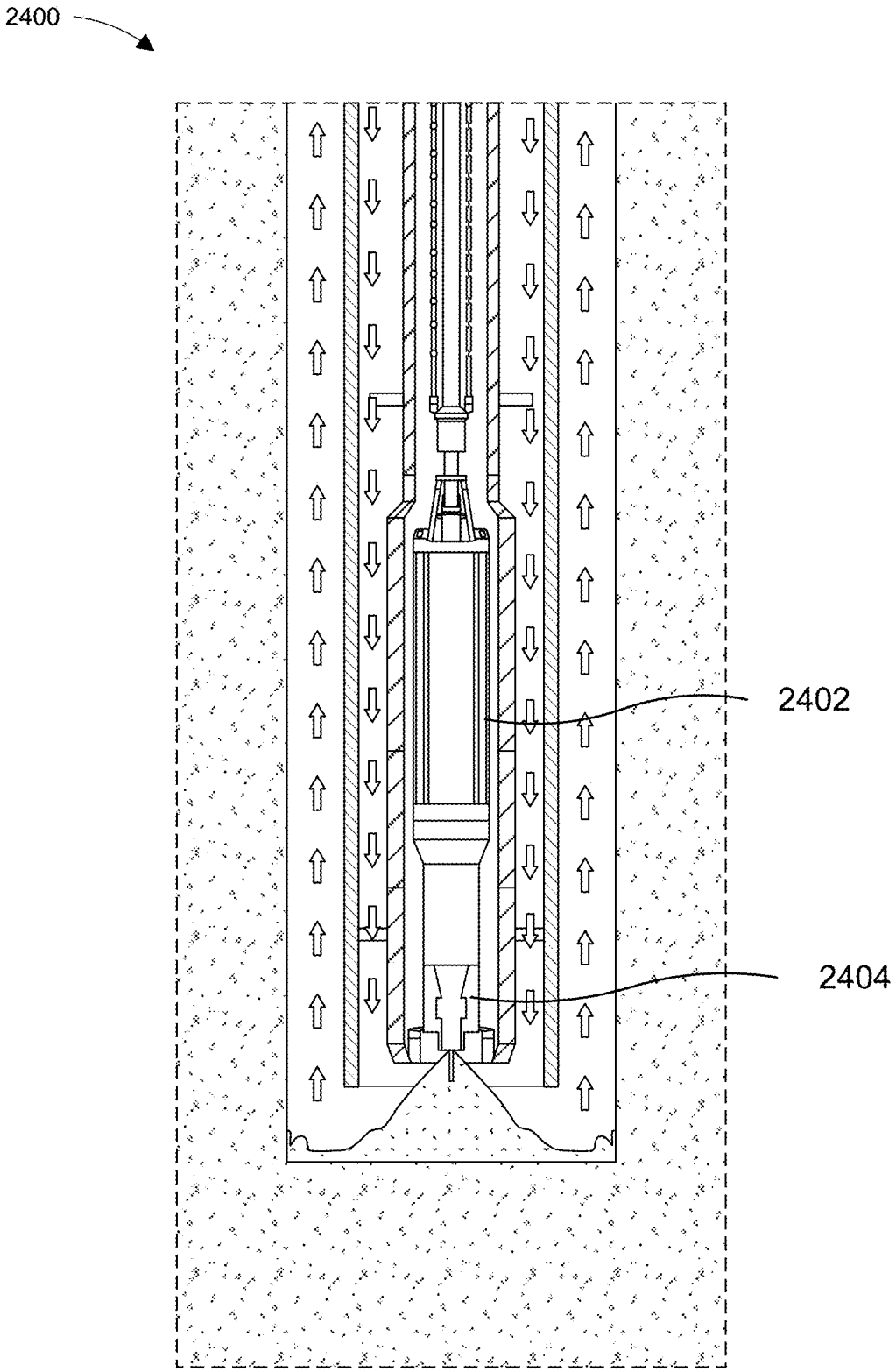
FIG. 24 illustrates an alternative fuel delivery system for a bitless drilling assembly.

In still another option for a bitless fuel delivery system, shown in FIG. 24, a bottom hole assembly (BHA) 2404 can be provided, wherein the BHA 2402 can be adapted to have a tool 2404 for bitless drilling located therein. The tool 2404 can be connected at one end to hosing that extends through the drill string back to the surface and the fuel can be delivered to the bitless drilling tool at the bottom of the wellbore through the hose.

The bitless fuel delivery system may be coupled to one or more control systems, such as any of those described above. For purposes of the following discussion, the control system for the bitless fuel delivery may be separate from or a part of the control systems described above. In one embodiment, a fuel delivery control system is coupled to one or more surface sensors, one or more downhole sensors, and/or one or more drilling control systems. The control system can receive drilling parameter information for one or more drilling parameters, such as ROP, WOB, torque, differential pressure, and/or one or more other drilling parameters noted above. The fuel delivery control system can receive such information and monitor progress and then determine whether the fuel being delivered should be increased, decreased, or maintained at its current level. For example, the control system can be coupled to one or more pumps coupled to one or more hoses to deliver the fuel and can control the one or more pumps to increase or decrease the amount of fuel being delivered downhole, as well as control the timing of any such increase or decrease so that the additional or lesser fuel arrives downhole at the nozzle at the correct time for drilling operations.

In one embodiment, the fuel delivery control system receives information indicating an amount of drilling progress, determines whether the amount of progress is within a target range, falls below or exceeds a threshold therefor, and if the amount of progress is below the target range or a threshold value, sends one or more signals to a fuel delivery system to increase the amount of fuel being delivered. The one or more control signals may also signal the amount of the increase, which may be responsive to the amount by which the amount of drilling progress falls below the target range or threshold therefor. If the fuel delivery system determines that the amount of progress is greater than desired, such as w % ben the amount exceeds a threshold therefor or is above a target range therefor, the control system can send one or more signals to the fuel delivery system to decrease the amount of fuel being delivered, and the amount of the decrease can be determined by the amount by which the amount of progress exceeds the threshold therefor or the target range for progress. Such a control system can be used to control the amount of fuel to be delivered if the fuel is in liquid form and delivered via one or more hoses or is in capsule form and delivered to the nozzle with a drilling fluid such as with any of the fuel delivery systems described herein.

As described in patent application Ser. No. 17/823,485, filed on Aug. 30, 2022, and entitled "Systems and Methods for Drilling Geothermal Wells," a guiding device may be used to help guide and direct the drill bit drilling a borehole towards a heat source. For example, a device such as a bottom hole assembly may include one or more portions or components that comprise one or more thermomechanical actuators. Such thermomechanical actuators may comprise thermal expansion portions or components that respond to a heat source and/or a heat differential and direct the drill bit towards the heat source. In one such approach, the drill string and/or BHA may include one or more portions or components that comprise amplified metal thermal expansion materials, such as bimetallic thermal actuators, pseudo bimorph thermal actuators, and/or may use geometric constraints to obtain the desired actuation towards a heat source. In one such an embodiment, the BHA or drill string components or portions that are heated more (e.g., are closer to a heat source) expand at a first rate responsive to their material's first thermal coefficient and due to the exposure to the heat, while other components or portions made from a second material with a different thermal coefficient expand at a different rate. The different expansion rates of the two materials of the components or portions thus can be used to direct or steer the drill bit towards the geothermal heat source. Such systems and methods may be used in addition to any or all of the sensors, control systems, and techniques described above for directional drilling of a borehole.

It should be noted that one or more portions or components of the nozzle, the BHA, and/or the drill string in a bitless drilling system and method like those described herein may comprise thermal expansion materials, such as the bimetallic thermal actuators, pseudo bimorph thermal actuators, or the like. In one embodiment, the nozzle may comprise one or more thermal actuator portions or components that bend due to the heat of the burning fuel and direct the burning fuel in a particular direction or directions. For example, a fuel delivery control system can be adapted to obtain readings regarding tool face orientation, MWD information, or LWD information during drilling and use some or all of such information to determine an orientation of the drilling. The control system can determine whether the expected orientation of the drilling conforms with the planned drilling of the wellbore (such as by comparing the expected trajectory to a well plan) and, if the expected trajectory varies from the desired well plan, the control system can increase or decrease the amount of fuel delivered to one or more ports of the nozzle, thus generating temperature one or more differential temperatures at the one or more ports. The ports may be located at one or more locations of the nozzle and use one or more thermal actuator components or portions so that the heat differential changes the orientation of the burning fuel and thus the drilling of the wellbore. For example, if the nozzle includes three or more ports, it should be possible to generate a directional bias for drilling by the nozzle in any direction. With the control system monitoring the orientation of the drilling and controlling the delivery of fuel to the ports, such as by sending more fuel to one port than received at another port, the control system can be used to automatically increase, decrease, or maintain the amount of fuel delivered to each port of the nozzle and thereby control the direction of the drilling.

In yet another embodiment, the nozzle may include a plurality of ports arranged in a way so that the burning fuel creates one or more desired effects besides melting the rock. For example, the nozzle may include one or more ports for the fuel having an angled orientation so that the burning fuel from such ports and the nozzle's movement can be used to ream out a wellbore. In addition, or alternatively, one or more ports can be orientated so that the burning fuel provides WOB or thrust. Similarly, the one or more ports can be oriented so that they cause rotation of the nozzle to scrape cuttings. In such an embodiment, the nozzle may further comprise one or more cutting surfaces such as one or more PDC bits. In addition, or in the alternative, the nozzle may comprise one or more ports which may be used to create a vortex or a Venturi effect near the bit that can help to move cuttings out of the way of the nozzle and thereby avoid recuts or reburns which would be an inefficient use of energy. Further, it should be appreciated that, by orientating the one or more ports, the thrust of the burning fuel from such ports may provide sufficient thrust to rotate the nozzle without the need for a motor, such as a mud motor in conventional drilling operations. In some embodiments, the fuel may be delivered to each of a plurality of ports, but the fluid pathways may differ in size so that one port receives more fuel than another port. In other words, the various ports may burn different amounts of fuel and thereby create different force or thrust amounts in different directions as may be desired or may burn the same amount.

In some cases, the fuel combustion generates enough heat to essentially de-nature the rock in an area that extends outwardly beyond the rock that is contacted and removed by the burning fuel. In such situations, the rock in the vicinity of the flame may soften considerably. In one embodiment, a drill bit having one or more conventional PDC cutting surfaces and one or more ignition ports or nozzles (such as in place of one of the mud nozzles in a conventional drill bit) can be included. In this system, the one or more ports or nozzles from which the burning fuel extends allows the drill bit cutting surfaces to more easily cut and remove the rock from the wellbore and uses less fuel than a purely combustion bitless drilling approach, such as described elsewhere herein. Moreover, it is believed that this approach will result in a smoother wellbore and also will result in less bit wear of the cutting surfaces.

The use of batteries for sensors and controls in the BHA or otherwise downhole will present challenges for high temperature bitless drilling applications like those described herein. Generally, such devices may be rendered inoperable or of limited use in drilling situations like those described herein. As noted, the bit or nozzle that emits the burning fuel may be oriented to provide thrust in a desired direction. Besides use of such oriented thrusters to create rotation that can be used to turn a bit or clean the hole, the rotation could also be used to generate power through a generator. The use of such a generator to provide power to sensors and control systems downhole could eliminate or at least reduce the need for batteries downhole, such as in the BHA. In one embodiment, a nozzle or bit such as described herein can include one or more ports oriented to provide thrust that rotates the nozzle or bit, and a generator which generates power that can be provided to one or more downhole sensors, control systems, or other electrically powered devices, either in addition to or in lieu of power provided by one or more batteries.

In yet another embodiment, which may be in addition to or an alternative to the use of the generator described above, it should be possible to harvest some of the extreme thermal energy proximal to the ports by using one or more thermoelectric devices to generate electrical power for the downhole system, including the sensors, control systems, and other electric devices, such as those located in the BHA. Thermoelectric devices useful for such systems and methods can include those described in co-pending U.S. Provisional Patent Application Ser. No. 63/380,448, filed on Oct. 21, 2022, and entitled "Systems and Methods for Generating and Storing Energy," which is hereby incorporated by reference as if fully set forth herein. A number of thermoelectric devices like those described in the foregoing patent application can be placed within the BHA and/or within one or more pipes in the drill string, such as in locations proximal the nozzle or the one or more ports. It is expected that such locations are likely to present the greatest temperature differentials and therefore thermoelectric devices placed in such locations are expected to produce the most electric current. Such devices typically provide a DC current, which can be provided to the one or more sensors, control systems, or other electric components in the BHA, and/or the DC current can be transformed to an AC current, which can also be provided to such sensors, control systems and other downhole devices. The electric power from such thermoelectric devices can be used to eliminate or at least reduce the need for batteries or other power supplies for such downhole sensors, control systems, and electric devices. Such thermoelectric devices may be disposed within a pipe or BHA in a manner like those described in the foregoing co-pending application.

Figure 25:
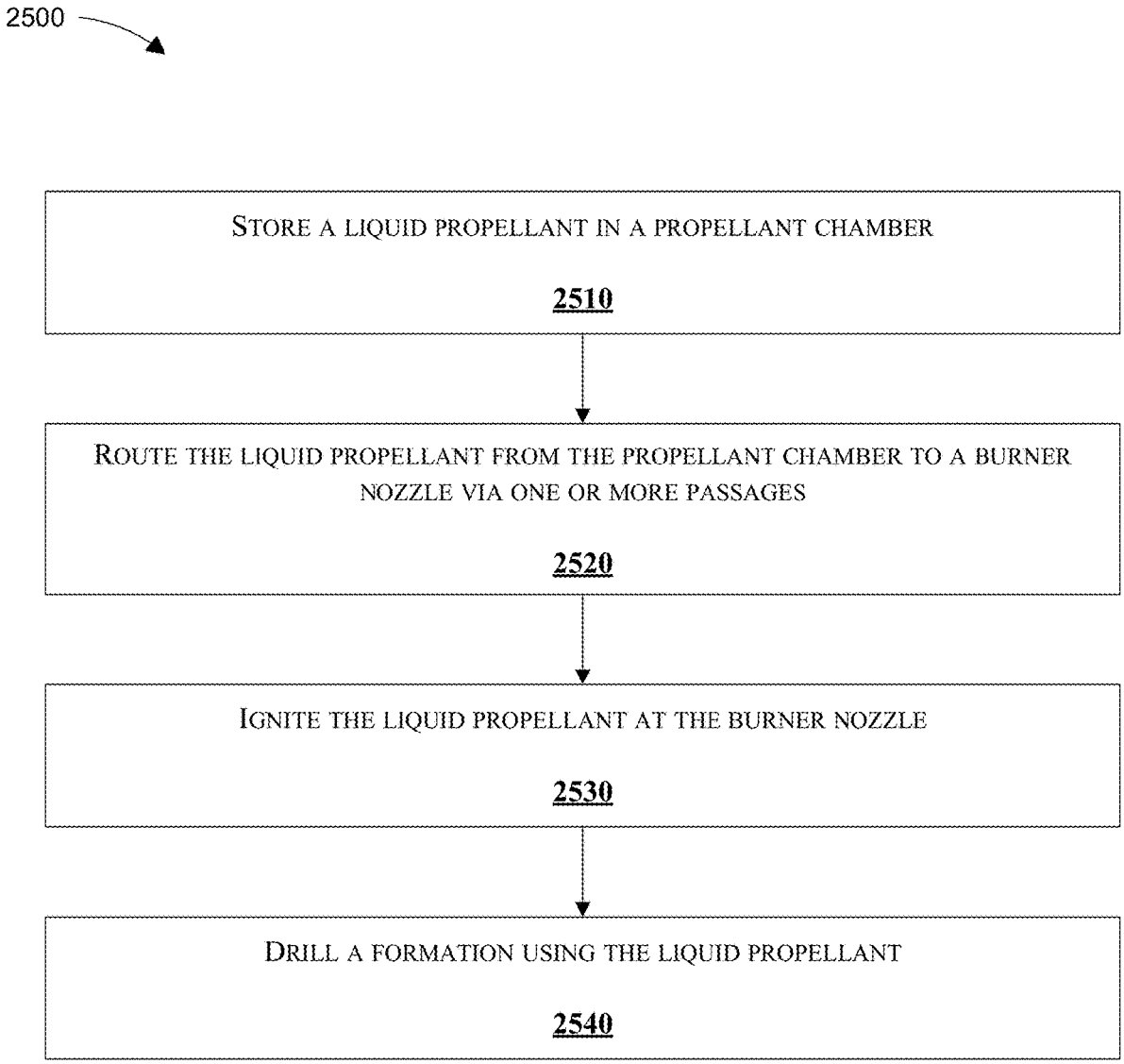
FIG. 25 illustrates a process for drilling using a bitless drilling assembly.

FIG. 25 is a flowchart of an example process 2500 associated with methods and systems for drilling that involve the use of a combustible fuel to advance a wellbore through a formation. After first providing an assembly adapted to use a combustible fuel in a wellbore to be advanced, the flowchart starts at step 2510.

At block 2510, process 2500 may include storing a liquid propellant or fuel in a propellant chamber in an assembly located at the bottom or end of the wellbore. The liquid propellant can be stored in one or more reservoir. In various embodiments, a hose can refill the reservoir while the reservoir is in a wellbore.

At block 1620, process 1600 may include routing the liquid propellant from the propellant chamber to a burner nozzle via one or more passages in the assembly. The liquid propellant can be routed from the propellant chamber to the burner nozzle using a gravity feed. In various embodiments, the liquid propellant can be pressurized to provide a positive force from the propellant chamber to the burner nozzle via the one or more passages in the assembly.

At block 1630, process 1600 may include igniting the liquid propellant at the burner nozzle, with the resulting combustion adapted to melt the rock formation through which the wellbore is advanced. In various embodiments, an ignitor assembly can provide a spark or flame to ignite the liquid propellent. In various embodiments, the ignitor can be electrically powered. In various embodiments, the ignitor assembly can be configured to only operate to initially ignite the propellent. In various embodiments, the ignitor assembly can routinely provide ignition to ensure the liquid propellant continues to burn during drilling.

At block 1640, process 1600 may include drilling a formation using the liquid propellant. The burning liquid propellant can burn through the rock formation by melting the rock in the formation.

Process 1600 can include additional implementations, such as any single implementation or any combination of implementations described below and/or in connection with one or more other processes described elsewhere herein.

In various implementations, process 1600 can include receiving additional liquid propellant to the propellant chamber visa a coupling for a fuel hose.

In various implementations, process 1600 can include diverting one or more fuel capsules from an inside passage of a pipe encasing the bitless drill assembly. In various implementations, process 1600 can include piercing the one or more fuel capsules using a capsule blade. In various implementations, process 1600 can include capturing the propellant from the one or more fuel capsules.

In various implementations, process 1600 can include routing the one or more fuel capsules from the capsule blade to a surface via an outside passage of the pipe encasing the bitless drill assembly.

In various implementations, the burner nozzle may be oriented at an angle with respect to longitudinal axis of the assembly and/or the drill string. In such an approach, the combustion of the fuel will melt the rock in a desired direction, such as achieved with conventional slide drilling techniques. Alternatively, the nozzle may be oriented in a vertical position with respect to the longitudinal axis of the assembly and/or the drill string, thus advancing the wellbore in substantially the same direction as is the case with conventional rotary drilling techniques.

As used below, any reference to a series of examples is to be understood as a reference to each of those examples disjunctively (e.g., "Examples 1-4" is to be understood as "Examples 1, 2, 3, or 4").

Example 1 is an apparatus for drilling, comprising: a propellant chamber configured to store a liquid propellant for drilling; a burner nozzle connected to the propellant chamber via one or more passages to route the liquid propellant from the propellant chamber to the burner nozzle; and an ignitor configured to ignite the liquid propellant as the liquid propellant escapes the burner nozzle.

Example 2 is the apparatus of example(s) 1, further comprising a connector for coupling a propellant feed hose.

Example 3 is the apparatus of example(s) 1, wherein the burner nozzle is encased in a drill pipe to create a path for a drilling fluid that bypasses the burner nozzle and feeds fluid down an inside passage and up an outside passage of the drill pipe.

Example 4 is the apparatus of example(s) 3, further comprising: a diverter cage placed in a path of the inside passage to divert one or more propellant capsules from the inside passage to a capsule blade, the capsule blade configured to puncture the one or more propellant capsules; and a reservoir configured to capture the propellant from the one or more propellant capsules and route the fuel to the propellant chamber.

Example 5 is the apparatus of example(s) 4, further comprising a diverter configured to route one or more pierced capsules to the outside passage of the large internal diameter drill pipe.

Example 6 is the apparatus of example(s) 4, further comprising: a burner nozzle monitor configured to detect a condition of the burner nozzle; and a compressed gas cylinder coupled to the drill pipe, the compressed gas cylinder configured to release the compressed gas into a chamber to cause the apparatus to float to a surface of a borehole.

Example 7 is the apparatus of example(s) 4, wherein the diverter cage comprises a mesh size smaller than a diameter of the one or more propellant capsules.

Example 8 is the apparatus of example(s) 1, wfherein the burner nozzle comprises a high temperature, high abrasion ceramic.

Example 9 is a bottom hole assembly for drilling a borehole, comprising: a propellant chamber configured to store a liquid propellant for drilling; a burner nozzle connected to the propellant chamber via one or more passages to route the liquid fuel from the propellant chamber to the burner nozzle; and an ignitor configured to ignite the liquid fuel as the propellant escapes the burner nozzle.

Example 10 is the bottom hole assembly of example(s) 9, further comprising a connector for coupling a propellant feed house.

Example 11 is the bottom hole assembly of example(s) 9, wherein the burner nozzle is encased in a large internal diameter drill pipe to create a path for a drilling fluid that bypasses the burner nozzle and feeds fluid down an inside passage and up an outside passage of the large internal diameter drill pipe.

Example 12 is the bottom hole assembly of example(s) 11, further comprising: a diverter cage placed in a path of the inside passage to divert one or more propellant capsules from the inside passage to a capsule blade; the capsule blade configured to puncture the one or more propellant capsules; and a reservoir configured to capture the propellant from the one or more propellant capsules and route the fuel to the propellant chamber.

Example 13 is the bottom hole assembly of example(s) 12, further comprising a diverter configured to route one or more pierced capsules to the outside passage of the large internal diameter drill pipe.

Example 14 is the bottom hole assembly of example(s) 12, further comprising: a burner nozzle monitor configured to detect a condition of the burner nozzle, and a compressed gas cylinder coupled to the large internal diameter pipe, the compressed gas cylinder configured to release the compressed gas into a chamber to cause the apparatus to float to a surface of a borehole.

Example 15 is the bottom hole assembly of example(s) 12, wherein the diverter cage comprises a mesh size smaller than a diameter of the one or more propellant capsules.

Example 16 is the bottom hole assembly of example(s) 9, wherein the burner nozzle comprises a high temperature, high abrasion ceramic.

Example 17 is a method for drilling a borehole using a bitless drill assembly, comprising: storing a liquid propellant in a propellant chamber; routing the liquid propellant from the propellant chamber to a burner nozzle via one or more passages; igniting the liquid propellant at the burner nozzle; and drilling a formation using the liquid propellant.

Example 18 is the method of example(s) 17, further comprising: receiving additional liquid propellant to the propellant chamber visa a coupling for a fuel hose.

Example 19 is the method of example(s) 17, further comprising: diverting one or more fuel capsules from an inside passage of a pipe encasing the bitless drill assembly; piercing the one or more fuel capsules using a capsule blade; and capturing the propellant from the one or more fuel capsules.

Example 20 is the method of example(s) 19, further comprising: routing the one or more fuel capsules from the capsule blade to a surface via an outside passage of the pipe encasing the bitless drill assembly.

Example 21 is a system for bitless drilling, the system comprising: a fuel chamber adapted to store a liquid fuel for drilling; means for providing fuel to the fuel chamber; a burner nozzle in fluid communication with the fuel chamber; and an igniter proximal one end of the burner nozzle, wherein the igniter is adapted to ignite the fuel as it leaves the burner nozzle.

Example 22 is a system of example(s) 21, wherein the means for providing fuel to the fuel chamber comprises a tube coupled at one end to the fuel chamber, or a fluid pathway coupled to the fuel chamber, wherein the tube extends through a drill string located in a wellbore to a surface connection.

Example 23 is the system of example(s) 21, wherein the means for providing fuel to the fuel chamber comprises a diverter adapted to divert a plurality of fuel capsules to a piercing instrument that is adapted to pierce an outer layer of the plurality of fuel capsules.

Example 24 is the system of example(s) 23, wherein the diverter is adapted to divert the plurality of fuel capsules towards the center of the drill string.

Example 25 is the system of example(s) 21, wherein the means for providing fuel to the fuel chamber comprises a sub having a first end and a second end, with the first end adapted to be connected to an end of a first pipe and the second end adapted to be connected to the end of a second pipe, wherein a first tube is located in the first pipe and a second tube is located within the second pipe, and wherein the first tube and the second tube extend at least partially into the sub, wherein each of the first tube and the second tube are adapted to provide fluid communication with an interior chamber in the sub, and wherein the interior chamber in the sub is sealed against the flow of a drilling fluid thereinto from the first pipe and the second pipe.

Example 26 is the system of example(s) 23, wherein each of the plurality of capsules comprises an outer layer having a first density and fuel therein, wherein the fuel has a second density which is greater than the first density.

Example 27 is the system of example(s) 26, wherein the drilling fluid has a third density that is greater than the first density and less than the second density.

Example 28 is a system for drilling a well, the system comprising: a processor coupled to a memory, wherein the memory comprises instructions for: receiving rate of penetration (ROP) data; determining if the ROP is within a target range therefor, or exceeds a threshold therefore or falls below a threshold therefor; and sending one or more control signals to a control system to adjust the flow of a fuel being delivered to a nozzle that is adapted to burn the fuel proximal to a formation being drilled if the ROP falls outside the target range therefor, exceeds a threshold therefor, or falls below a threshold therefor.

Example 29 is a system for drilling a well, the system comprising: a bottom hole assembly (BHA) comprising a burner having one or more ports through which ignited fuel is ejected, wherein at least a first port of the one or more ports is oriented to direct the ignited fuel ejected therefrom in a predetermined direction during drilling of a wellbore.

Example 30 is the system according to claim 29, wherein the BHA further comprises one or more mechanical bits or cutting surfaces.

Example 31 is the system according to claim 30, wherein the first port is oriented so that the ignited fuel ejected therefrom generates a rotational movement of the BHA.

Example 32 is the system according to either claim 28 or 29, further comprising one or more thermoelectric devices located proximal the nozzle or the one or more ports and adapted to generate an electric current.

Example 33 is the system according to claim 32 wherein the one or more thermoelectric devices are coupled to one or more downhole sensors, one or more processors, one or more control systems, or one or more electrical components and provide electric power to the same.

Example 34 is the system according to claim 31, further comprising one or more generators adapted to generate electricity using the rotational movement of the BHA.

Example 35 is the system according to claim 34, wherein the one or more generators are coupled to one or more downhole sensors, one or more processors, one or more control systems, or one or more electrical components and provide electric power to the same.

It is to be noted that the foregoing description is not intended to limit the scope of the claims. For example, it is noted that the disclosed methods and systems include additional features and can use additional drilling parameters and relationships beyond the examples provided. The examples and illustrations provided in the present disclosure are for explanatory purposes and should not be considered as limiting the scope of the invention, which is defined only by the following claims.

What is claimed is:

1. An apparatus for drilling, comprising:

a propellant chamber configured to store a liquid propellant for drilling;

a burner nozzle connected to the propellant chamber via one or more passages to route the liquid propellant from the propellant chamber to the burner nozzle;

an ignitor configured to ignite the liquid propellant as the liquid propellant escapes the burner nozzle, wherein the burner nozzle is encased in a drill pipe to create a path for a drilling fluid that bypasses the burner nozzle and feeds the drilling fluid down an inside passage and up an outside passage of the drill pipe;

a diverter cage placed in a path of the inside passage to divert one or more propellant capsules from the inside passage to a capsule blade, wherein the capsule blade is configured to puncture the one or more propellant capsules; and a reservoir configured to capture the propellant from the one or more propellant capsules and route the propellant to the propellant chamber.

2. The apparatus of claim 1, further comprising a connector for coupling a propellant feed hose.

3. The apparatus of claim 1, further comprising a diverter configured to route one or more pierced capsules to the outside passage of the drill pipe.

4. The apparatus of claim 1, further comprising:

a burner nozzle monitor configured to detect a condition of the burner nozzle; and a compressed gas cylinder coupled to the drill pipe, the compressed gas cylinder configured to release the compressed gas into a chamber to cause the apparatus to float to a surface of a borehole.

5. The apparatus of claim 1, wherein the diverter cage comprises a mesh size smaller than a diameter of the one or more propellant capsules.

6. The apparatus of claim 1, wherein the liquid propellant comprises hydrazine, monomethylhydrazine, unsymmetrical dimethylhydrazine, dinitrogen tetroxide, or a combination thereof.

7. A bottom hole assembly for drilling a borehole, comprising:

a propellant chamber configured to store a liquid propellant provided as one or more propellant capsules for drilling;

a burner nozzle connected to the propellant chamber via one or more passages to route the propellant of the one or more propellant capsules from the propellant chamber to the burner nozzle; and an ignitor configured to ignite the propellant of the one or more propellant capsules as the propellant escapes the burner nozzle.

8. The bottom hole assembly of claim 7, further comprising a connector for coupling a propellant feed hose.

9. The bottom hole assembly of claim 7, wherein the burner nozzle is encased in a large drill pipe to create a path for a drilling fluid that bypasses the burner nozzle and feeds the drilling fluid down an inside passage and up an outside passage of the drill pipe.

10. The bottom hole assembly of claim 9, further comprising:

a diverter cage placed in a path of the inside passage to divert the one or more propellant capsules from the inside passage to a capsule blade;

the capsule blade configured to puncture the one or more propellant capsules; and a reservoir configured to capture the propellant from the one or more propellant capsules and route the propellant to the propellant chamber.

11. The bottom hole assembly of claim 10, further comprising a diverter configured to route one or more pierced capsules to the outside passage of the drill pipe.

12. The bottom hole assembly of claim 10, further comprising:

a burner nozzle monitor configured to detect a condition of the burner nozzle; and a compressed gas cylinder coupled to the pipe, the compressed gas cylinder configured to release the compressed gas into a chamber to cause the bottom hole assembly to float to a surface of a borehole.

13. The bottom hole assembly of claim 10, wherein the diverter cage comprises a mesh size smaller than a diameter of the one or more propellant capsules.

14. The bottom hole assembly of claim 7, wherein the one or more liquid propellant capsules comprise hydrazine, monomethylhydrazine, unsymmetrical dimethylhydrazine, dinitrogen tetroxide, or a combination thereof.

15. A method for drilling a borehole using a bitless drill assembly, comprising:

storing a liquid propellant in a propellant chamber;

routing the liquid propellant from the propellant chamber to a burner nozzle;

routing a drilling fluid through a path created by the burner nozzle encased in a drill string such that the drilling fluid bypasses the burner nozzle and feeds the drilling fluid down an inside passage and up an outside passage of the drill string;

igniting the liquid propellant at the burner nozzle;

drilling a formation using the liquid propellant;

diverting one or more fuel capsules from the inside passage of the drill string encasing the bitless drill assembly;

piercing the one or more fuel capsules using a capsule blade; and capturing the propellant from the one or more fuel capsules.

16. A method for drilling a borehole using a bitless drill assembly, comprising:

storing a liquid propellant in a propellant chamber;

routing the liquid propellant from the propellant chamber to a burner nozzle;

routing a drilling fluid through a path created by the burner nozzle encased in a drill string such that the drilling fluid bypasses the burner nozzle and feeds the drilling fluid down an inside passage and up an outside passage of the drill string;

igniting the liquid propellant at the burner nozzle;

drilling a formation using the liquid propellant;

diverting one or more fuel capsules from the inside passage of the drill string encasing the bitless drill assembly;

piercing the one or more fuel capsules using a capsule blade;

capturing the propellant from the one or more fuel capsules; and routing the one or more fuel capsules from the capsule blade to a surface via the outside passage of the drill string encasing the bitless drill assembly.

17. The method of claim 15, wherein the one or more liquid propellant capsules comprise hydrazine, monomethylhydrazine, unsymmetrical dimethylhydrazine, dinitrogen tetroxide, or a combination thereof.

18. The method of claim 16, wherein the one or more liquid propellant capsules comprise hydrazine, monomethylhydrazine, unsymmetrical dimethylhydrazine, dinitrogen tetroxide, or a combination thereof.

19. The method of claim 16, wherein the one or more propellant capsules are diverted via a diverter cage placed in a path of the inside passage to divert the one or more propellant capsules from the inside passage to the capsule blade.

* * * * *